US012611605B2

(12) United States Patent
Yokoyama et al.

(10) Patent No.: US 12,611,605 B2
(45) Date of Patent: Apr. 28, 2026

(54) TACTILE PRESENTATION APPARATUS AND TACTILE CONTROL APPARATUS

(71) Applicant: SONY GROUP CORPORATION, Tokyo (JP)

(72) Inventors: Ryo Yokoyama, Tokyo (JP); Yohei Fukuma, Tokyo (JP); Taha Moriyama, Tokyo (JP); Yusuke Nakagawa, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 444 days.

(21) Appl. No.: 18/253,206

(22) PCT Filed: Nov. 4, 2021

(86) PCT No.: PCT/JP2021/040542
§ 371 (c)(1),
(2) Date: May 16, 2023

(87) PCT Pub. No.: WO2022/113678
PCT Pub. Date: Jun. 2, 2022

(65) Prior Publication Data

US 2024/0009581 A1 Jan. 11, 2024

(30) Foreign Application Priority Data

Nov. 24, 2020 (JP) ..... 2020-194480

(51) Int. Cl.
*A63G 31/14* (2006.01)
*A63G 31/04* (2006.01)

(52) U.S. Cl.
CPC ..... *A63G 31/14* (2013.01); *A63G 31/04* (2013.01)

(58) Field of Classification Search
CPC ..... A63G 31/02; A63G 31/04; A63G 31/06; A63G 31/14
See application file for complete search history.

(56) References Cited

U.S. PATENT DOCUMENTS 1,454,775 A * 5/1923 Unger ..... A63G 31/14 472/48
5,333,876 A * 8/1994 Goto ..... A63B 69/3652 473/134
2021/0052989 A1* 2/2021 Blum ..... A63F 13/80
(Continued)

FOREIGN PATENT DOCUMENTS

CN 106621343 A * 5/2017 ..... A63G 31/00
JP 11-015367 A 1/1999
(Continued)

OTHER PUBLICATIONS

International Search Report and Written Opinion of PCT Application No. PCT/JP2021/040542, issued on Jan. 11, 2022, 08 pages of ISRWO.

*Primary Examiner* — Alexander K Garlen
(74) *Attorney, Agent, or Firm* — CHIP LAW GROUP

(57) ABSTRACT

A tactile presentation apparatus according to an embodiment of the present technology includes a movable member, an elastic portion, and at least one drive unit. The elastic portion supports the movable member. The at least one drive unit is connected to the movable member, moves the movable member so as to elastically deform the elastic portion, and is capable of keeping the elastic portion elastically deformed.

18 Claims, 14 Drawing Sheets

(56) References Cited

U.S. PATENT DOCUMENTS

| | | | | |
|---|---|---|---|---|
| 2021/0052990 | A1* | 2/2021 | Stepanian | A63G 31/16 |
| 2023/0061598 | A1* | 3/2023 | Weinberg | A63F 13/245 |

FOREIGN PATENT DOCUMENTS

| | | | | |
|---|---|---|---|---|
| JP | 2019-066805 | A | 4/2019 | |
| JP | 2019-184774 | A | 10/2019 | |
| WO | WO-2021079760 | A1 * | 4/2021 | A47C 3/0251 |

* cited by examiner

FIG. 5A
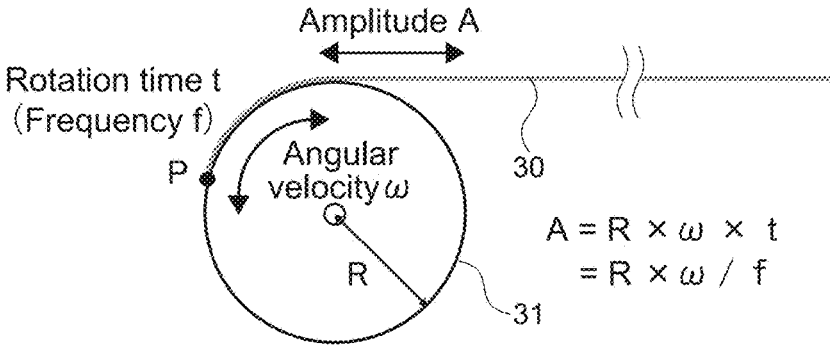
FIG. 5B
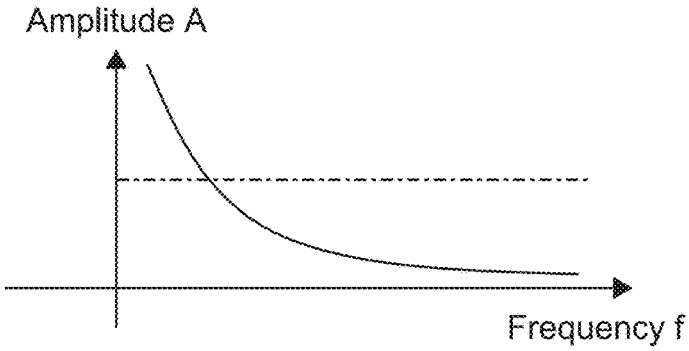
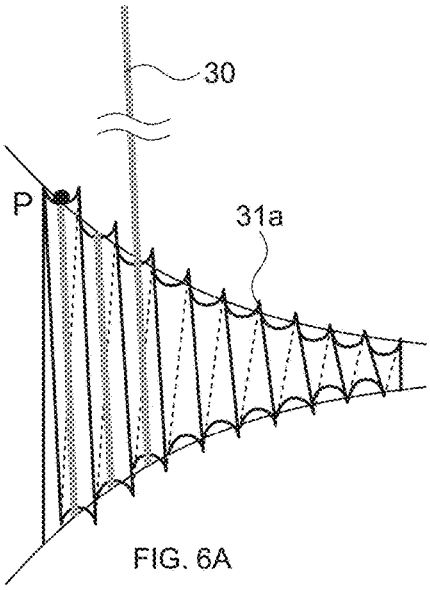
FIG. 6A
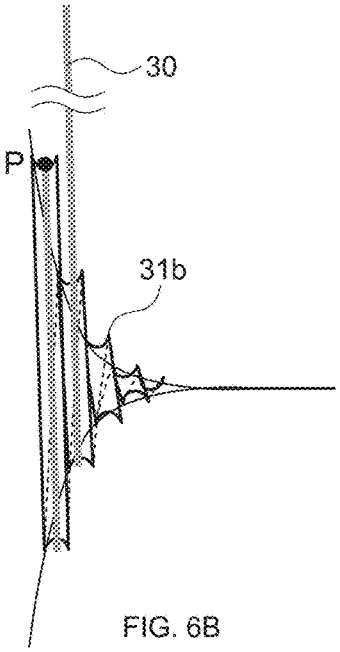
FIG. 6B

FIG. 10A
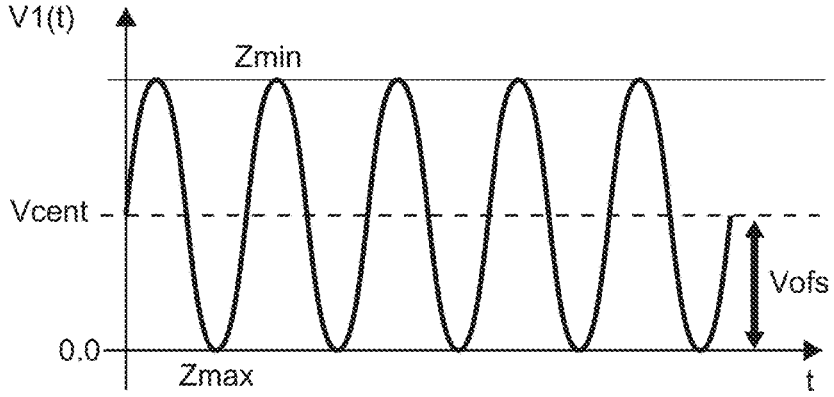
FIG. 10B
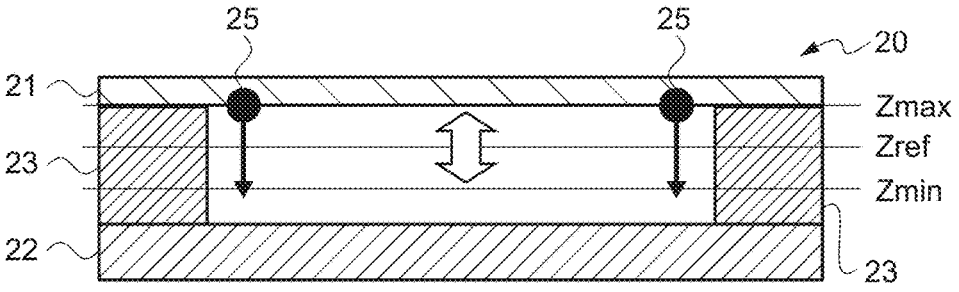
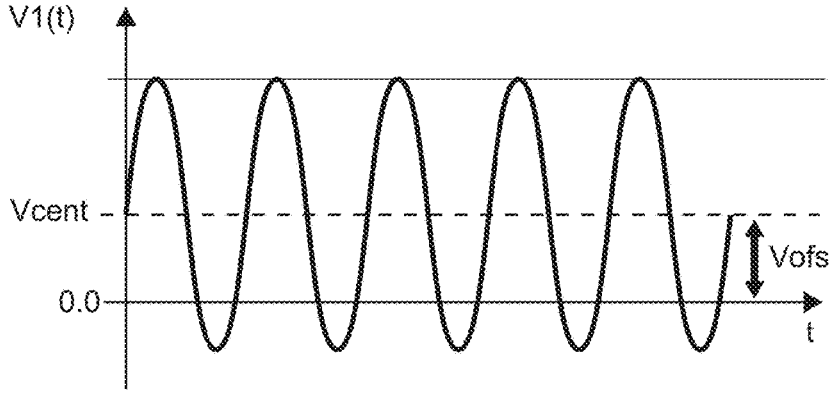
FIG. 11

FIG. 12A
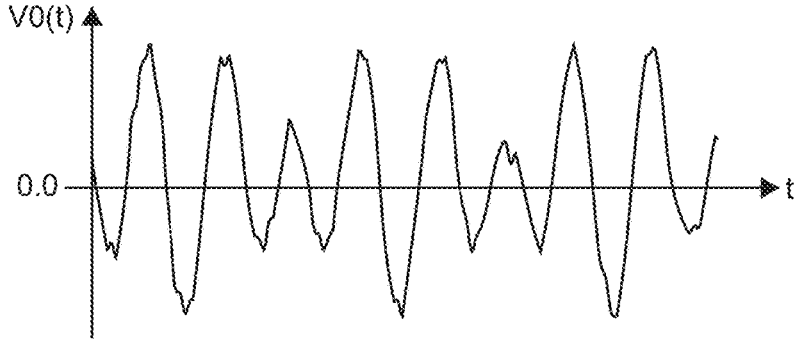
FIG. 12B
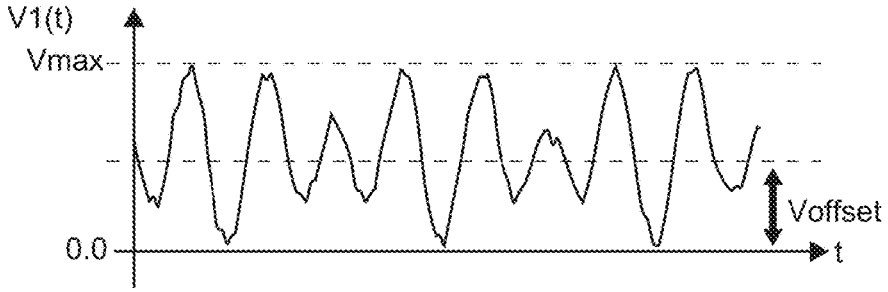
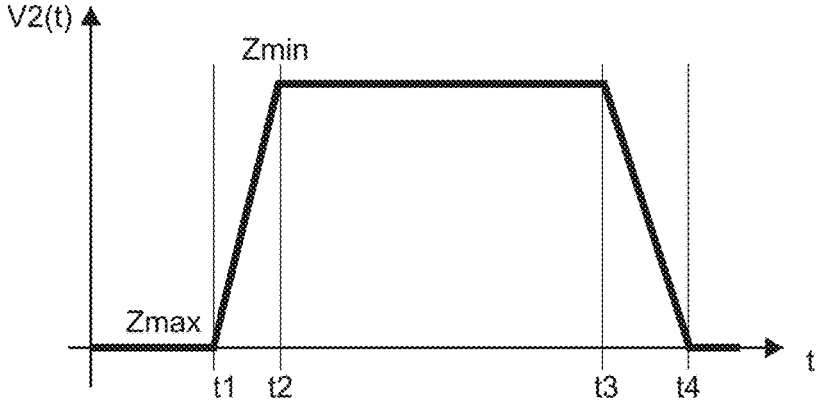
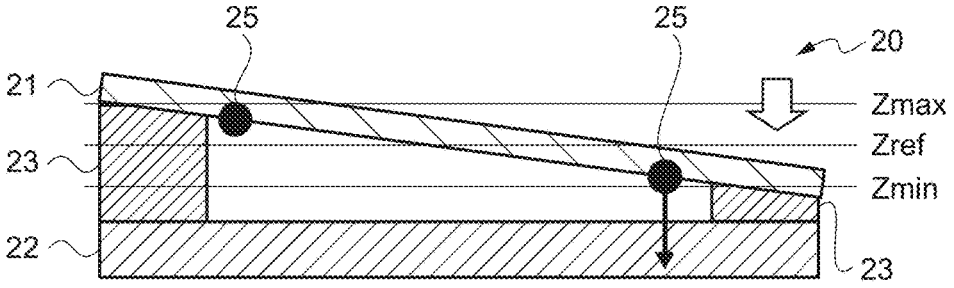
FIG. 13

FIG. 16A
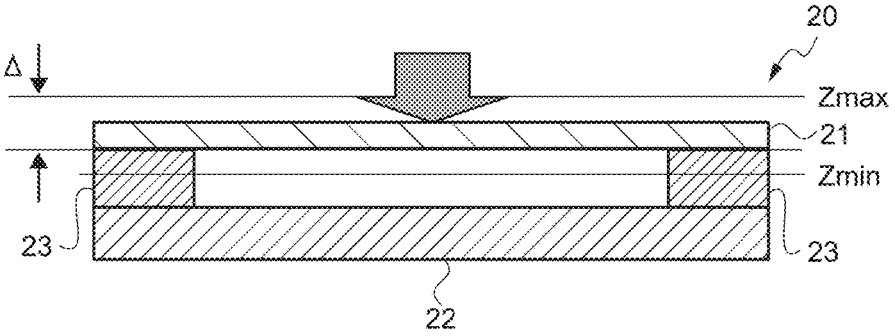
FIG. 16B
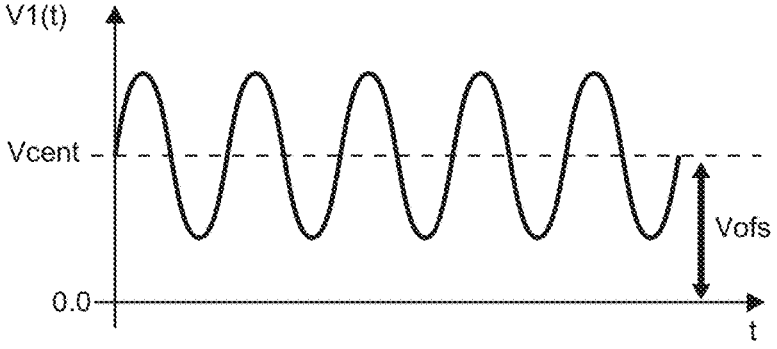
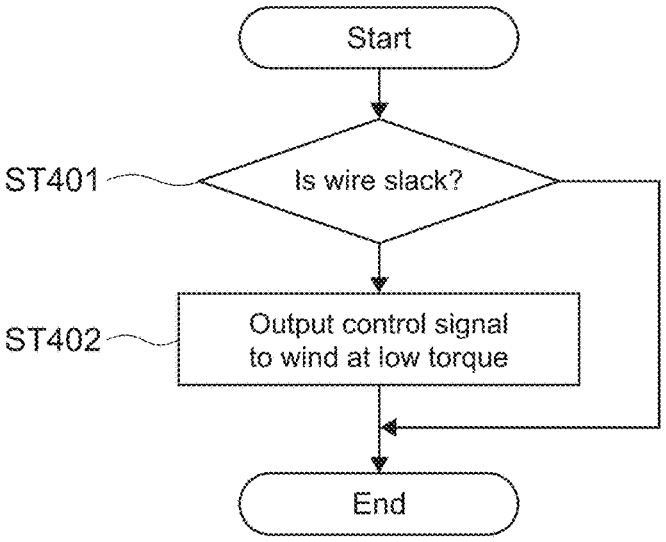
FIG. 17

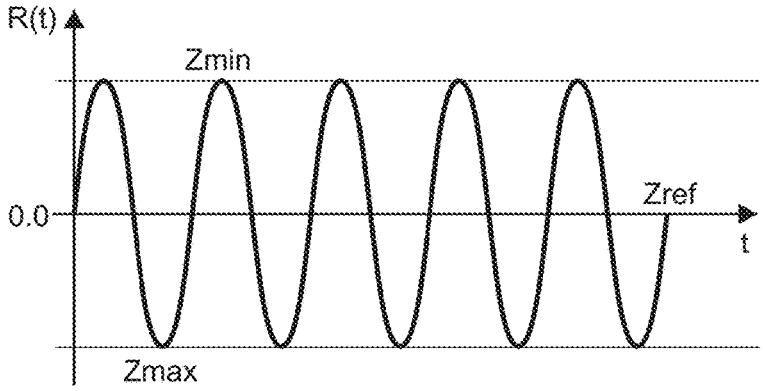
FIG. 18A
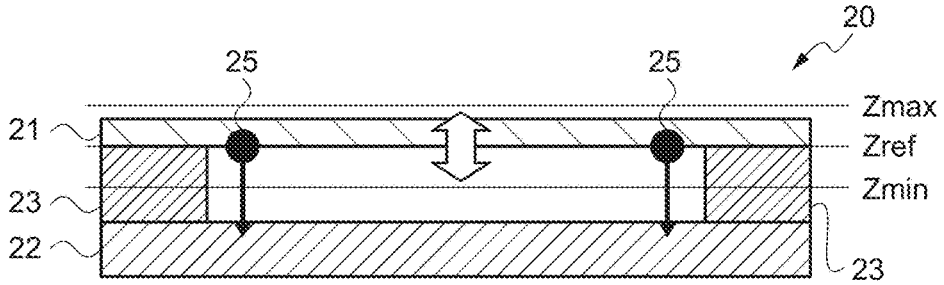
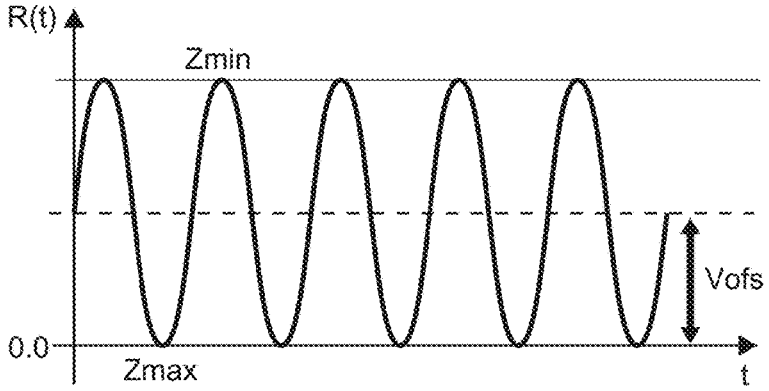
FIG. 18B
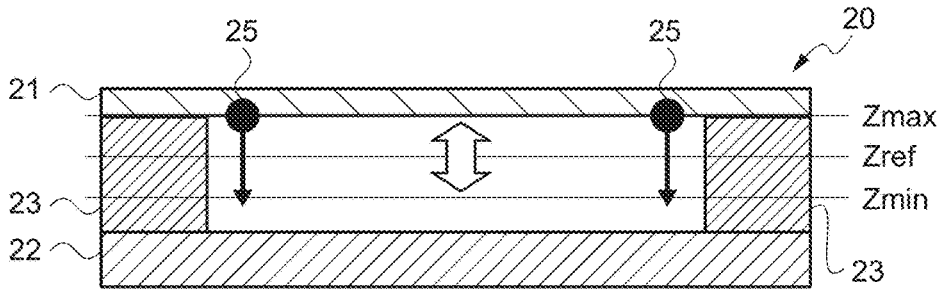

TACTILE PRESENTATION APPARATUS AND TACTILE CONTROL APPARATUS

CROSS REFERENCE TO RELATED APPLICATIONS

This application is a U.S. National Phase of International Patent Application No. PCT/JP2021/040542 filed on Nov. 4, 2021, which claims priority benefit of Japanese Patent Application No. JP 2020-194480 filed in the Japan Patent Office on Nov. 24, 2020. Each of the above-referenced applications is hereby incorporated herein by reference in its entirety.

TECHNICAL FIELD

The present technology relates to a tactile presentation apparatus for presenting a tactile sense to a user and to a tactile control apparatus.

BACKGROUND ART

Conventionally, apparatuses for presenting a tactile sense to a user have been developed. For example, these apparatuses can provide various experiences by presenting tactile senses in conjunction with video and sounds.

For example, Patent Literature 1 has disclosed a movement simulator that moves a seating tool on which the user sits in conjunction with a video or sound. This movement simulator includes a plurality of actuators for supporting the seating tool. Each actuator is coupled with a coupling base movable upward and downward. Moreover, the coupling base connects to an elastic member arranged to cancel a load applied to the actuator. This allows a reduction of a force necessary for moving the actuator upward. Thus, a compact drive apparatus can be employed (paragraphs [0009], [0054], [0055], and in specification, FIG. 11, FIG. 12, etc. of Patent Literature 1).

CITATION LIST

Patent Literature

Patent Literature 1: Japanese Patent Application Laid-open No. 2019-184774

DISCLOSURE OF INVENTION

Technical Problem

The technology for presenting a tactile sense to a user as described above is expected to be applied in various fields such as amusement and education. It is thus desirable to provide a technology capable of presenting a wide variety of tactile senses and downsizing the device.

In view of the above-mentioned circumstances, it is an objective of the present technology to provide a tactile presentation apparatus and a tactile control apparatus that can realize a compact device for presenting a wide variety of tactile senses.

Solution to Problem

In order to accomplish the above-mentioned objective, a tactile presentation apparatus according to an embodiment of the present technology includes a movable member, an elastic portion, and at least one drive unit.

The elastic portion supports the movable member.

The at least one drive unit is connected to the movable member, moves the movable member so that the elastic portion is elastically deformed, and is capable of keeping the elastic portion elastically deformed.

In this tactile presentation apparatus, the at least one drive unit is connected to the movable member supported by the elastic portion. Such a drive unit moves the movable member so as to be capable of keeping the elastic portion elastically deformed. This enables the movable member to move due to a force to restore the elastic portion. Thus, a compact device for presenting a wide variety of tactile senses can be realized.

The movable member may be a stage on which a user is able to get.

The tactile presentation apparatus may further include tactile control unit that acquires specifying information regarding a vibration or attitude of the movable member and controls the at least one drive unit on the basis of the specifying information.

The movable member may include at least one connection portion to which the at least one drive unit is connected. In this case, the at least one drive unit may move the movable member by pulling the connection portion to the at least one drive unit is connected.

The movable member may be a plate-like member arranged along a reference surface. In this case, the drive unit may pull the movable member in a direction crossing the reference surface.

The drive unit may pull the movable member in a direction orthogonal to the reference surface.

The drive unit may pull the movable member so that the movable member slides along the reference surface.

The drive unit may pull the movable member so that the movable member rotates using an axis orthogonal to the reference surface as a center.

The specifying information may include information specifying a vibration pattern of the movable member. In this case, the tactile control unit may select a drive unit of the at least one drive unit, which corresponds to the vibration pattern, and fluctuate an amount of pulling by which the selected drive unit pulls the movable member in accordance with the vibration pattern.

The specifying information may include information specifying a tilted attitude of the movable member. In this case, the tactile control unit may select a drive unit from the at least one drive unit, which corresponds to the tilted attitude, and keep an amount of pulling by which the selected drive unit pulls the movable member at a value according to the tilted attitude.

The drive unit may include a wire connected to the movable member, a reel for winding the wire, and a motor for rotating the reel. In this case, the tactile control unit may generate a control signal to control rotation of the motor on the basis of the specifying information.

The reel may be configured so that an amount of winding the wire decreases as a rotation amount of the motor increases.

The control signal may be a signal specifying a voltage to drive the motor or a rotation amount of the motor.

The tactile presentation apparatus may further include a load sensor that detects load information representing a load applied to the motor. In this case, the tactile control unit may correct the control signal on the basis of the load information.

The load sensor may include at least one of a current sensor that detects a current flowing through the motor, a pressure sensor that detects a pressure with respect to the movable member, and an attitude sensor that detects an attitude of the movable member.

The at least one drive unit may include a plurality of drive units. In this case, the tactile control unit may correct the control signal on the basis of the load information so that a load on the motor that each of the plurality of drive units has is equal.

The tactile control unit may estimate a load applied to the movable member on the basis of the load information and correct the control signal so that a force by which the motor pulls the movable member increases as the load increases.

The movable member may be a stage on which a user is able to get. In this case, the tactile control unit may estimate a position of user on the movable member on the basis of the load information and corrects the control signal to an amount of pulling by which the motor pulls the movable member decreases when the position of the user is an end of the movable member.

The tactile control unit may rotate the motor so as to eliminate slack of the wire.

A tactile control apparatus according to an embodiment of the present technology includes an acquisition unit and a control unit.

The acquisition unit acquires specifying information regarding a vibration or attitude of a movable member supported by an elastic portion.

The control unit controls at least one drive unit on the basis of the specifying information, the at least one drive unit being connected to the movable member, moving the movable member so that the elastic portion is elastically deformed, and being capable of keeping the elastic portion elastically deformed.

BRIEF DESCRIPTION OF DRAWINGS

FIGS. 5A and 5B A schematic diagram for describing properties of a reel for winding a wire.

FIGS. 6A and 6B A schematic diagram showing a configuration example of the winding reel.

FIGS. 10A and 10B A schematic diagram for describing a vibration signal.

FIG. 11 A graph showing another example of a voltage signal for vibrating a top plate portion.

FIGS. 12A and 12B A schematic diagram showing a generation example of a vibration signal using an audio signal as an original signal.

FIG. 13 A schematic diagram for describing a tilt signal.

FIGS. 16A and 16B A schematic diagram describing correction processing according to a load applied to the top plate portion.

FIG. 17 A flowchart showing an example of slack elimination processing.

FIGS. 18A and 18B A schematic diagram showing an example of position control of a motor.

MODE(S) FOR CARRYING OUT THE INVENTION

Hereinafter, embodiments according to the present technology will be described with reference to the drawings.

[Outline of Tactile Presentation System]

Figure 1:
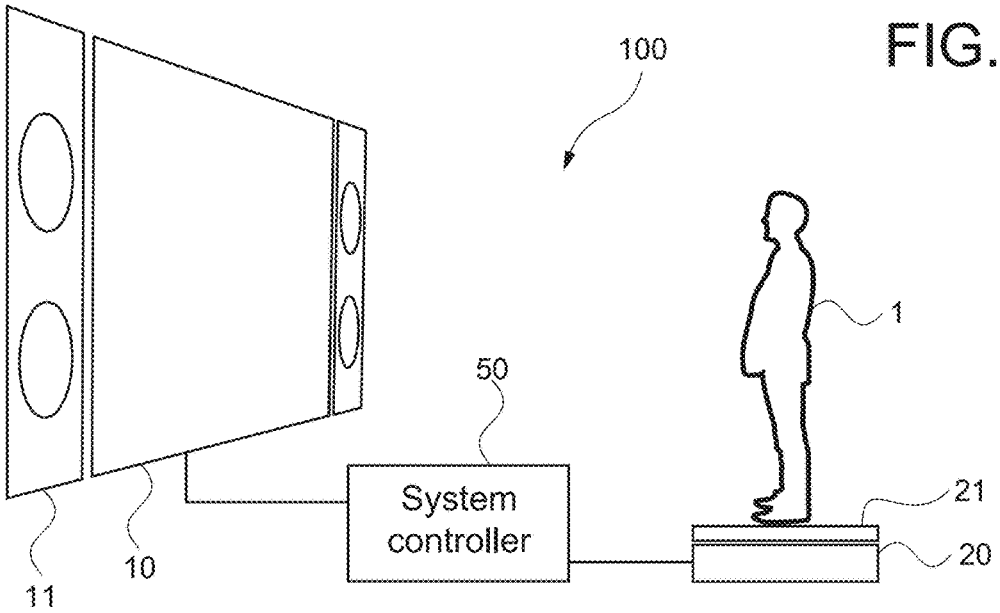
FIG. 1 A schematic diagram outlining a tactile presentation system according to an embodiment of the present technology.
Figure 2:
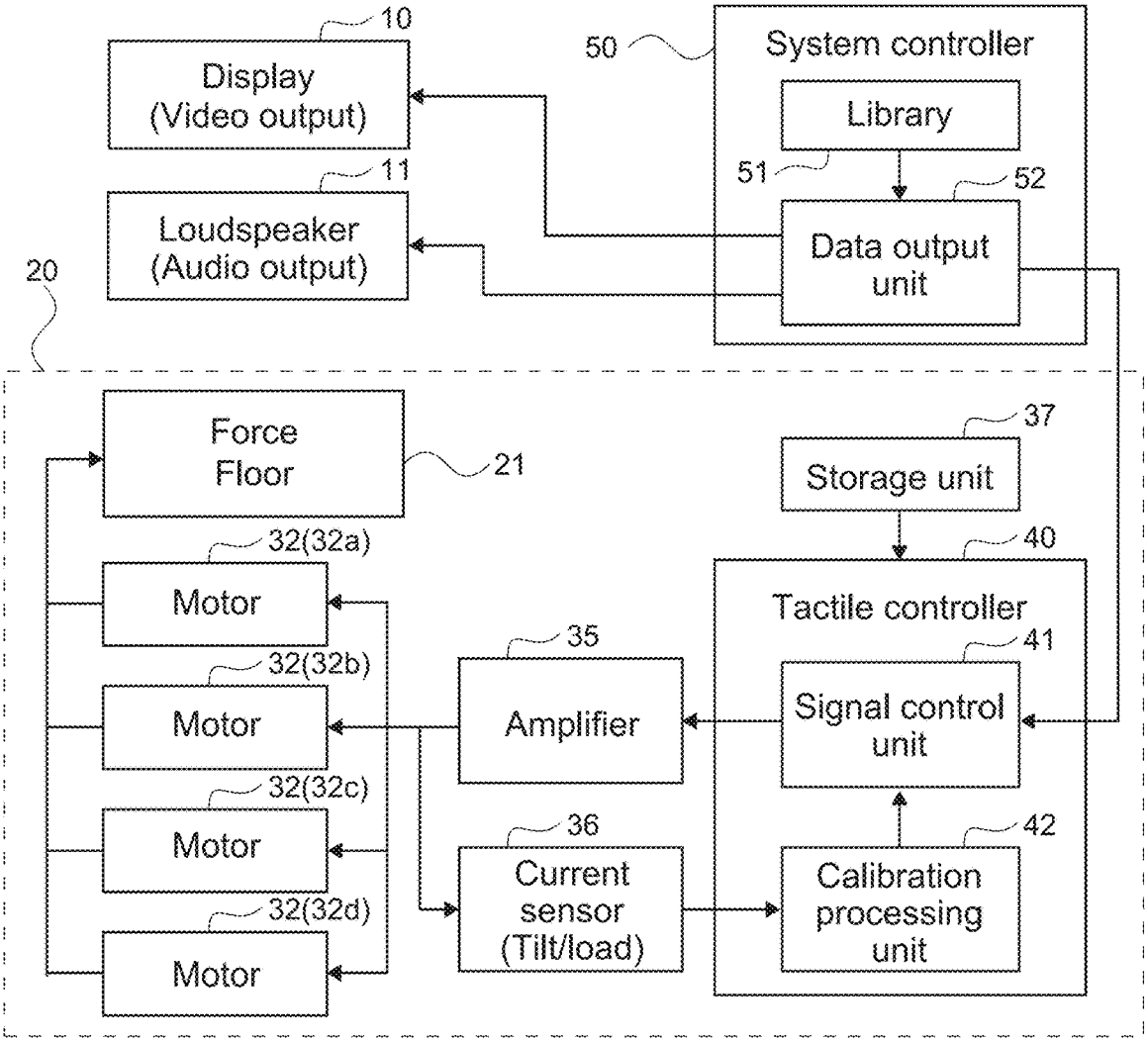
FIG. 2 A block diagram showing functional configuration examples of the tactile presentation system.

FIG. 1 is a schematic diagram outlining a tactile presentation system according to an embodiment of the present technology. FIG. 2 is a block diagram showing functional configuration examples of a tactile presentation system 100.

The tactile presentation system 100 includes a display 10, loudspeakers 11, a tactile presentation apparatus 20, and a system controller 50.

The tactile presentation system 100 is a system for presenting a tactile sense to a user 1 with a video or sound through the tactile presentation apparatus 20. In the present disclosure, a sensation that can be provided by physically moving the tactile presentation apparatus 20 to the user 1 in contact with the tactile presentation apparatus 20 will be referred to as a tactile sense.

As shown in FIG. 1, the tactile presentation apparatus 20 is configured as a stage for the user 1. For example, the tactile presentation apparatus 20 physically moves a member (top plate portion 21 to be described later) on which the user 1 stands in order to present to the user 1 various tactile senses such as a vibration sensation and an acceleration/deceleration sensation.

Here, the user 1 is assumed to stand on the tactile presentation apparatus 20, though not limited thereto. For example, a sheet for the user 1 to sit on the tactile presentation apparatus 20 may be fixedly arranged.

The display 10 is a reproduction apparatus for reproducing a video.

For example, the display 10 is a self-emitting display such as a liquid-crystal display (LCD), an organic EL display, and an LED display. Alternatively, the display 10 may be a projector display using projection or the like. Otherwise, the display 10 may be a wearable display such as a head-mounted display (HMD).

The loudspeakers 11 are reproduction apparatuses for reproducing a sound. In the example shown in FIG. 1A, the loudspeakers 11 are arranged on the right and left sides of the display 10. Otherwise, the loudspeakers 11 may be earphones, headphones, or the like.

Figure 3A:
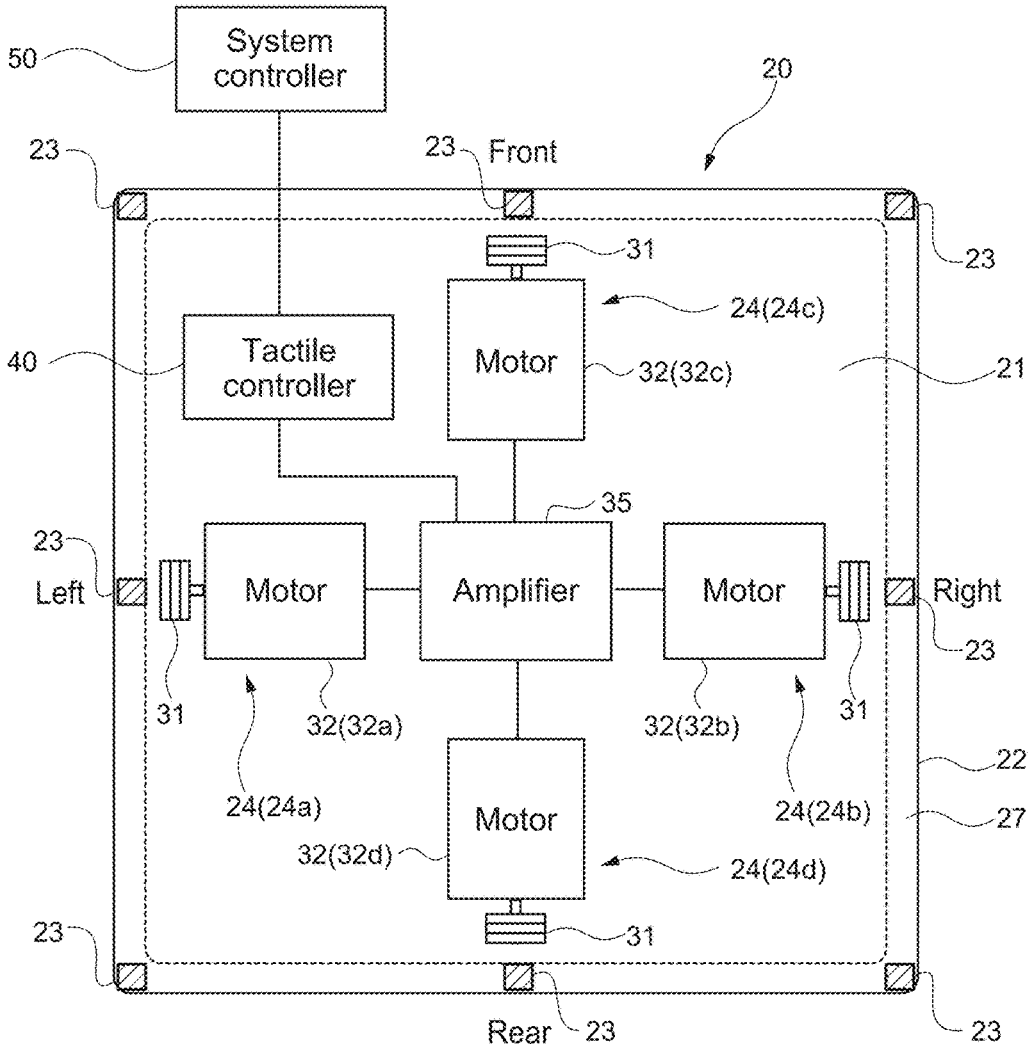
FIGS. 3A and 3B A schematic diagram showing a configuration example of a tactile presentation apparatus.
Figure 3B:
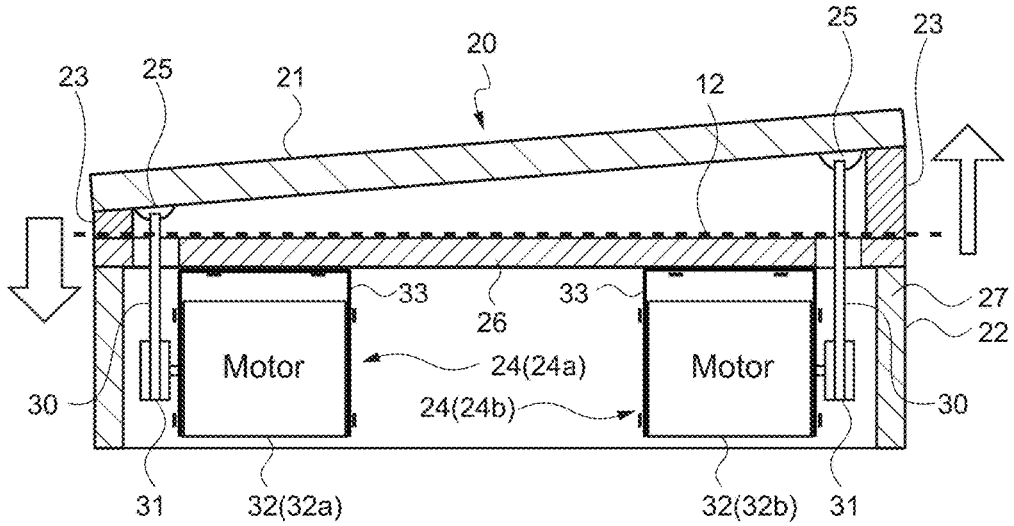

[Configuration of Tactile Presentation Apparatus] FIGS. 3A and 3B are schematic diagrams showing a configuration example of the tactile presentation apparatus 20. The tactile presentation apparatus 20 is a generally box-shaped apparatus. The tactile presentation apparatus 20 is used arranged on a horizontal floor or the like. FIG. 3A is a schematic diagram of the interior of the tactile presentation apparatus 20 as viewed from above. FIG. 3B is a schematic diagram of the interior of the tactile presentation apparatus 20 as viewed from the side.

The tactile presentation apparatus 20 includes the top plate portion 21 (force floor), a base portion 22, dampers 23, and four drive units 24.

The top plate portion 21 is a plate-like member provided in an upper portion of the tactile presentation apparatus 20. The top plate portion 21 is a stage that can be moved by operation of the drive units 24. The top plate portion 21 used here has a substantially square plane shape as viewed above. For example, the top plate portion 21 is a square plate member with one side of about 1000 mm. It should be noted that the plane shape and the size of the top plate portion 21 are not limited and can be arbitrarily set. In the present embodiment, the top plate portion 21 corresponds to a movable member.

Moreover, the top plate portion 21 is arranged along a reference surface 12 in a state in which the drive units 24 are inactive (halted state). Here, the reference surface 12 is a surface as a reference for moving the top plate portion 21 and is typically a horizontal surface. It should be noted that the reference surface 12 may be a surface tilted with respect to the horizontal surface.

An upper surface of the top plate portion 21 is a standing surface for the user 1. The standing surface may have a mark showing a standing position for the user 1, slippery stops, and the like. The top plate portion 21 is thus a stage configured so that the user 1 can stand on it.

Moreover, a lower surface of the top plate portion 21 is a connection surface to which the dampers 23 and the drive units 24 connect. As shown in FIG. 3B, the connection surface has connection portions 25 for connecting to the drive units 24, respectively. Therefore, the top plate portion 21 has four connection portions 25 to which the four drive units 24 connect respectively in the example shown in FIGS. 3A and 3B. The connection portions 25 are fixtures for fixing wires 30 of the drive units 24 to be described later to the top plate portion 21. For example, the connection portions 25 are wire hooks, anchor bolts, or the like. In addition, any fixtures capable of fixing the wires 30 may be provided.

The base portion 22 is arranged in a lower portion of the tactile presentation apparatus 20. The base portion 22 serves as a base for a stage (top plate portion 21) on which the user 1 stands. The base portion 22 has a columnar structure with an upper surface having a shape similar to the top plate portion 21. The base portion 22 includes a lid portion 26 and a frame portion 27 for supporting the lid portion 26. The lid portion 26 constitutes an upper surface of the base portion 22. The frame portion 27 constitutes a side surface of the base portion 22.

The lid portion 26 is a plate-like member having a plane shape similar to the top plate portion 21. The lid portion 26 is disposed on the base portion 22. Moreover, the lid portion 26 has four apertures for the wires 30 of the four drive units 24. Hereinafter, the description will be given using an upper surface of the lid portion 26 as the reference surface 12.

The frame portion 27 is a frame-type member having a plane shape similar to the lid portion 26 (top plate portion 21). The frame portion 27 is connected to a lower surface of the lid portion 26, supporting a peripheral edge of the lid portion 26. This enables the entire frame portion 27 to receive a load applied to the lid portion 26.

Moreover, the drive units 24 (motors 32) are put in a space surrounded by the lid portion 26 and the frame portion 27 as shown in FIG. 3B. In this manner, the base portion 22 functions as a casing for the four drive units 24 (motors 32). In addition, the base portion 22 may house an amplifier 35 and a tactile controller 40 to be described later and other components such as a power source.

It should be noted that the bottom of the base portion 22 is opened in the example shown in FIGS. 3A and 3B. This allows facilitation of maintenance and the like for the tactile presentation apparatus 20. For example, a member for closing the bottom of the base portion 22 may be provided as a matter of course.

The dampers 23 support the top plate portion 21. The dampers 23 are elastic members that are elastically deformable. In the present disclosure, the elastic member is, for example, a member having properties that it is elastically deformed due to an external force and that it returns to the original shape due to a restoring force when the external force decreases.

For example, the dampers 23 are gel dampers used for anti-vibration and impact reduction. For example, a gel damper with a thickness of about 20 mm can ensure a range of deformation of about 10 mm. The thickness of the damper 23 is not limited and can be set as appropriate as a matter of course.

Alternatively, the dampers 23 may be elastic members such as rubbers and springs. Otherwise, the dampers 23 may be elastically deformable mechanisms such as air suspensions.

The dampers 23 are provided between the top plate portion 21 and the base portion 22 and support the top plate portion 21 on the base portion 22. Typically, the dampers 23 are arranged to support the peripheral edge of the top plate portion 21. In the example shown in FIGS. 3A and 3B, the dampers 23 are provided at eight positions which are four vertices of the square top plate portion 21 and middle points of the four sides.

It should be noted that the number and arrangement of dampers 23 are not limited.

The four drive units 24 are each connected to the top plate portion 21 and move the top plate portion 21 so as to elastically deform the dampers 23. That is, while the respective drive units 24 are moving the top plate portion 21, the dampers 23 are deformed in an elastic region and the top plate portion 21 receives forces from both the drive units 24 and the dampers 23.

Moreover, the respective drive units 24 are configured to keep the dampers 23 elastically deformed. That is, the respective drive units 24 can constantly output forces larger than restoring forces of the dampers 23 so as to continuously deform the dampers 23.

In the present embodiment, the respective drive units 24 are configured to move the top plate portion 21 by pulling the connection portions 25 connected to the respective drive units 24. Here, a mechanism for pulling the connection portions 25 via the wires 30 is used. The drive units 24 can be thus considered as pulling units for pulling the top plate portion 21 via the wires 30.

As shown in FIG. 3B, the four drive units 24 include the wires 30 each connected to the top plate portion 21, reels 31 for winding the wires 30, and the motors 32 for rotating the reels 31.

The wires 30 are, at one ends thereof, fixed to the corresponding connection portions 25 and are, at the other ends thereof, fixed to the reels 31. The wire 30 is typically a metal wire. However, the material and shape of the wire 30 are not limited.

The reel 31 is fixed to a rotational shaft of the motor 32. The reel 31 has a groove for guiding the wound wire 30, for example. The shape of the reel 31 will be described later.

The motor 32 rotates the rotational shaft (reel 31) in accordance with an input driving signal. Hereinafter, the direction of winding the wire 30 will be referred to as a normal rotation and the opposite direction will be referred to as an opposite rotation. The kind and the like of the motor 32 are not limited as long as it can output rotational torque capable of deforming the dampers 23, for example.

As shown in FIG. 3B, the respective motors 32 are fixed in the base portion 22 with predetermined fixtures 33. Thus, the top plate portion 21 is pulled to the lower side where the base portion 22 is located. In this manner, the respective drive units 24 pull the top plate portion 21 in a direction crossing the reference surface 12. This enables the position and attitude of the top plate portion 21 to change with respect to the reference surface 12. Thus, various tactile senses can be expressed.

It should be noted that in the example shown in FIGS. 3A and 3B, the lower surface of the lid portion 26 has the fixtures 33 and the motors 32 are fixed to the lid portion 26. Therefore, the motors 32 are pushed against the lid portion 26 when pulling the top plate portion 21. This prevents the fixtures 33 from receiving unnecessary forces. It can prevent the fixtures 33 from being loosened and damaged, for example.

Hereinafter, the left, right, upper, and lower sides in FIG. 3A will be referred to as left, right, front, and rear sides of the tactile presentation apparatus 20. For example, the front side of the tactile presentation apparatus 20 is a side where the display 10 is placed. Moreover, FIG. 3B shows an internal structure of the tactile presentation apparatus 20 as viewed from the rear side.

Moreover, the four drive units 24 (four motors 32) will be referred to as drive units 24*a* to 24*d* (motors 32*a* to 32*d*), respectively. The motors 32*a* to 32*d* are respectively arranged with the reels 31 (rotational shafts) oriented toward the middle on the left side, the middle on the right side, the middle on the front side, and the middle on the rear side of the base portion 22 (frame portion 27).

Moreover, the connection portions 25 to which the wires 30 fixed to the respective reels connect are respectively provided at positions on the lower surface of the top plate portion 21, which are directly above the reels 31 connected to the motors 32*a* to 32*d*. At that time, the positioned relationship between the connection portions 25 and the reels 31 is set so that a direction of pulling the wires 30 is a direction (vertical direction) orthogonal to the reference surface 12, for example.

In this manner, in the present embodiment, the respective drive units 24 (motors 32) are arranged to pull the top plate portion 21 in the direction orthogonal to the reference surface 12.

This allows efficient transmission of forces to pull the top plate portion 21 vertically. As a result, positions of the respective connection portions 25 in upper and lower directions can be changed with a minimum energy.

In FIG. 3B, the motor 32 (motor 32*a*) on the left side normally rotates, thereby winding the wire 30. In this case, the left side of the top plate portion 21 (connection portion 25 at the middle on the left side) is pulled downward. At that time, the damper 23 for supporting the left side of the top plate portion 21 contracts in accordance with the amount of pulling. This deformation of the damper 23 is elastic deformation. In this manner, the motor 32 winding the wire 30 fixed to the top plate portion 21 can cause the top plate portion 21 to sink toward the base portion 22.

Moreover, the motor 32 (motor 32*b*) on the right side in FIG. 3B stops winding of the wire 30 (rotation of the motor 32) after winding the wire 30 by a certain amount. In this case, the top plate portion 21 is pushed up due to a restoring force of the damper 23 elastically deformed by winding the wire 30. In this manner, the top plate portion 21 returns to the original position due to the restoring force of the damper 23 when the motor 32 stops winding.

It should be noted that the top plate portion 21 can also be pushed up when reducing torque to wind the wire 30 below the restoring force of the damper 23 without completely stopping winding of the motor 32. In this case, the top plate portion 21 returns to a position where the torque of the motor 32 is balanced with the restoring force.

As described above, the tactile presentation apparatus 20 moves the top plate portion 21 by winding of the wires 30 and restoring forces of the dampers 23. The simple configuration to wind the wires 30 by the motors 32 can change the position and attitude of the top plate portion 21. It can sufficiently downsize the apparatus, for example, as compared to a case of using actuators movable upward and downward, other vibration elements, or the like.

As shown in FIG. 2, the tactile presentation apparatus 20 further includes the amplifier 35, a current sensor 36, a storage unit 37, and the tactile controller 40.

The amplifier 35 is a signal amplifier circuit for amplifying a control signal for driving each drive unit 24 (motor 32). The amplifier 35 includes the same number of amplifier circuits as the drive units 24, for example, and uses each of the amplifier circuits to amplify each control signal.

The amplifier 35 receives inputs of control signals of the respective motors 32 generated by the tactile controller 40 to be described later. The amplifier 35 amplifies these control signals into a level (driving voltage) to drive the motors 32. The amplifier 35 outputs the amplified control signals to the respective motors 32.

A specific configuration of the amplifier 35 is not limited. For example, amplifier circuits may be used as appropriate depending on the kind and the like of the motors 32.

The current sensor 36 is a sensor for detecting a current flowing through each motor 32. The current sensor 36 is arranged to detect a current flowing through the wire connecting the motor 32 and the amplifier 35.

For example, it is known that a current flowing through the motor 32 (hereinafter, referred to as a motor current) increases as a load (torque load) applied to the motor 32 increases. Therefore, for example, the motor current becomes minimum when the motor 32 rotates freely and the motor current becomes maximum when a load to stop the rotation of the motor 32 is applied.

Therefore, detecting the motor current by the use of the current sensor 36 can detect a load applied to the motor 32. A detection result of the motor current detected by the current sensor 36 is used as load information indicating the load applied to the motor 32.

In this manner, in the present embodiment, the current sensor 36 functions as a load sensor that detects the load information indicating the load applied to the motor 32.

It should be noted that the load sensor that detects the load information may be a sensor other than the current sensor 36. For example, a pressure (load) applied to the top plate portion 21 changes the load applied to each motor 32.

Therefore, the load sensor may be a pressure sensor that detects a pressure with respect to the top plate portion 21.

Moreover, the load applied to each motor 32 is considered to change, for example, also in a case where the attitude of the top plate portion 21 changes depending on the standing position or the like of the user 1. Therefore, the load sensor may be an attitude sensor (e.g., an acceleration sensor) that detects the attitude of the top plate portion 21.

The storage unit 37 is a nonvolatile storage device. For example, the storage unit 37 is a recording medium using a solid-state element such as a solid state drive (SSD) or a magnetic recording medium such as a hard disk drive (HDD). In addition, the kind and the like of the recording medium used as the storage unit 37 are not limited, and for example, an arbitrary recording medium for recording non-temporary data may be used.

The storage unit 37 stores a control program according to the present embodiment. The control program is a program that controls the overall operation of the tactile presentation apparatus 20, for example.

The tactile controller 40 controls a tactile sense presented to the user 1 by controlling the movement of the top plate portion 21. Specifically, the tactile controller 40 acquires a force sense control file and controls the respective drive units 24 on the basis of the force sense control file. The force sense control file is specifying information specifying the vibration or attitude of the top plate portion 21.

In the present embodiment, a force sense control file recorded in a library of the system controller 50 to be described later is read. The force sense control file will be described later in detail.

The tactile controller 40 controls the operation of the tactile presentation apparatus 20. The tactile controller 40 has a hardware configuration necessary for a computer such as a CPU and memories (RAM, ROM), for example. The CPU loads the control program stored in the storage unit 37 to the RAM and executes it so as to execute various types of processing. In the present embodiment, the tactile controller 40 corresponds to a tactile control unit of the tactile presentation apparatus. Moreover, in the present embodiment, the tactile controller 40 functions as a tactile control apparatus.

For example, the tactile controller 40 may be a programmable logic device (PLD) such as a field programmable gate array (FPGA) or another device such as an application specific integrated circuit (ASIC). Moreover, for example, the tactile controller 40 may be a processor such as a graphics processing unit (GPU).

In the present embodiment, the CPU of the tactile controller 40 executes the control program according to the present embodiment so as to realize a signal control unit 41 and a calibration processing unit 42 as functional blocks. Then, these functional blocks execute a tactile control method according to the present embodiment. It should be noted that dedicated hardware such as an integrated circuit (IC) may be used as appropriate in order to realize the respective functional blocks.

The signal control unit 41 acquires a force sense control file and generates a control signal for controlling the rotation of the motors 32 on the basis of the acquired force sense control file. For example, the force sense control file output from the system controller 50 (data output unit 52) is read as appropriate and a control signal depending on its contents is generated for each of the motors 32.

The control signal is a signal specifying a voltage to drive the motor 32, for example. This is a signal specifying a direction of rotation of the motor 32, a rotation velocity (rotation torque), and the like as a voltage value.

For example, in a case where the force sense control file includes an instruction (e.g., a vibration pattern) to vibrate the top plate portion 21, a control signal to vibrate a voltage is generated in accordance with the vibration pattern.

It should be noted that in a case where the positions of the motors 32 can be controlled, the control signal may be a signal specifying rotation positions of the motors 32 instead of the voltage. It will be described with reference to FIGS. 18A and 18B, etc.

The calibration processing unit 42 corrects a control signal on the basis of the load information indicating the load applied to the motor 32. Here, the load information is a value of each motor current detected by the current sensor 36. Alternatively, the load information may be detection results of a pressure sensor, an attitude sensor, and the like.

For example, a motor 32 having a high load applied is determined on the basis of the load information. There is a possibility that driving such a motor 32 with a control signal without any correction cannot provide a desired amount of pulling. In such a case, correction, e.g., increasing the voltage of the motor 32 is performed so as to present the tactile sense specified by the force sense control file.

The calibration processing unit 42 calculates, for example, correction parameters for correcting the control signal (e.g., an offset value, an amplification of the amplitude) and output them to the signal control unit 41.

Alternatively, the calibration processing unit 42 may generate a superimposed signal to be superimposed on the control signal, for example. In this case, a signal combining the control signal and the superimposed signal is a corrected control signal.

In the present embodiment, the signal control unit 41 functions as an acquisition unit. Moreover, the signal control unit 41 and the calibration processing unit 42 cooperate to realize the control unit.

Specific operations of the signal control unit 41 and the calibration processing unit 42 will be described later in detail.

The system controller 50 controls operations of the respective units of the tactile presentation system 100. For example, the system controller 50 is a computer such as a PC and a server. As shown in FIG. 2, the system controller 50 includes a library 51 and a data output unit 52. It should be noted that the system controller 50 may realize the above-mentioned tactile controller 40.

The library 51 is a storage medium for storing data about various types of content to be reproduced by the tactile presentation system 100. The library 51 stores a video file, an audio file, and a force sense control file.

The video file is video data, e.g., a movie or live broadcast. The audio file is typically audio data of the video file.

The force sense control file is data recording contents of a tactile sense (force sense) that the tactile presentation apparatus 20 (top plate portion 21) presents to the user 1. The tactile sense presented to the user 1 is typically set in conjunction with contents of the video file and the audio file.

The force sense control file includes, for example, information specifying a vibration pattern of the top plate portion 21 (vibration information). The vibration information is, for example, information specifying a time for generating a vibration, the kind of vibration (e.g., up and down vibration or tilted vibration), a waveform of the vibration, parameters of the vibration (amplitude and frequency), and the like.

Moreover, the force sense control file includes, for example, information specifying the attitude of the top plate portion 21 (attitude information). Here, a tilt of the top plate portion 21 is specified as the attitude of the top plate portion 21. In this case, the attitude information is information specifying a time for making a tilt, an orientation of the tilt, an angle of the tilt (degree of tilt), and the like.

It should be noted that the kind and time of the vibration and the tilt are set in conjunction with the contents of the video file and the audio file. Moreover, the above-mentioned audio file may be used as the vibration information as it is. In this case, the audio file functions as the force sense control file.

The data output unit 52 outputs a file stored in the library 51 to each unit of the tactile presentation system 100. For example, the data output unit 52 outputs a video file to the display 10. Moreover, the data output unit 52 outputs an audio file to the loudspeakers 11. In this manner, the display 10 and the loudspeakers 11 reproduce the video and sound of the content.

Moreover, the tactile control file is output to the signal control unit 41 of the tactile controller 40. This enables the top plate portion 21 to move in accordance with the tactile control file.

[Basic Operation of Tactile Presentation Apparatus]

Figure 4A:
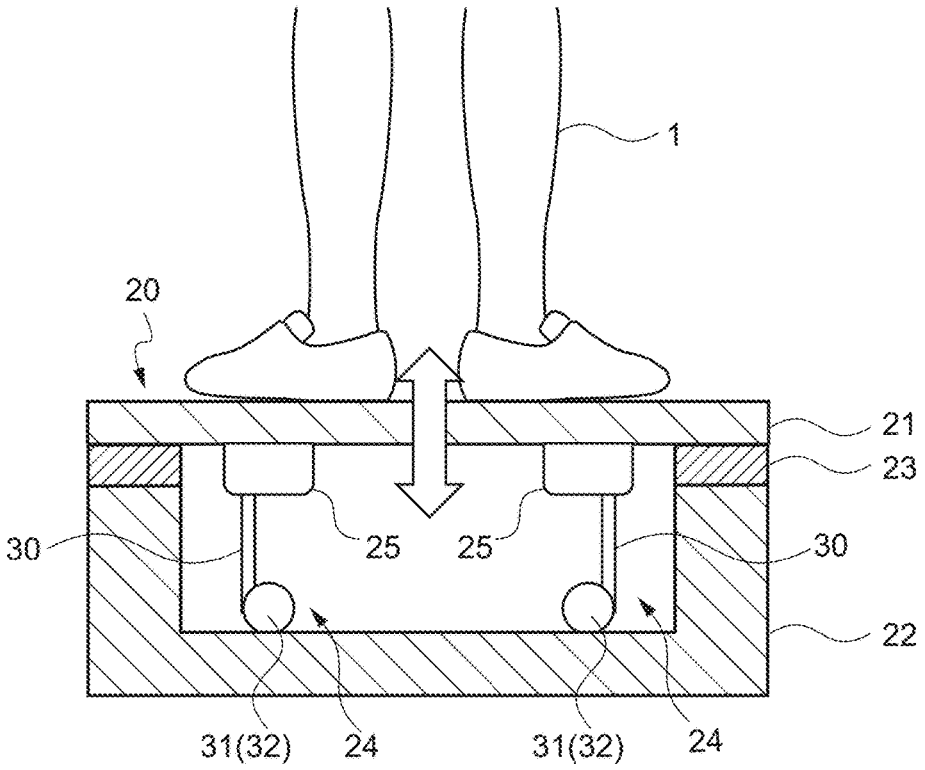
FIGS. 4A and 4B A schematic diagram showing an operation example of the tactile presentation apparatus.
Figure 4B:
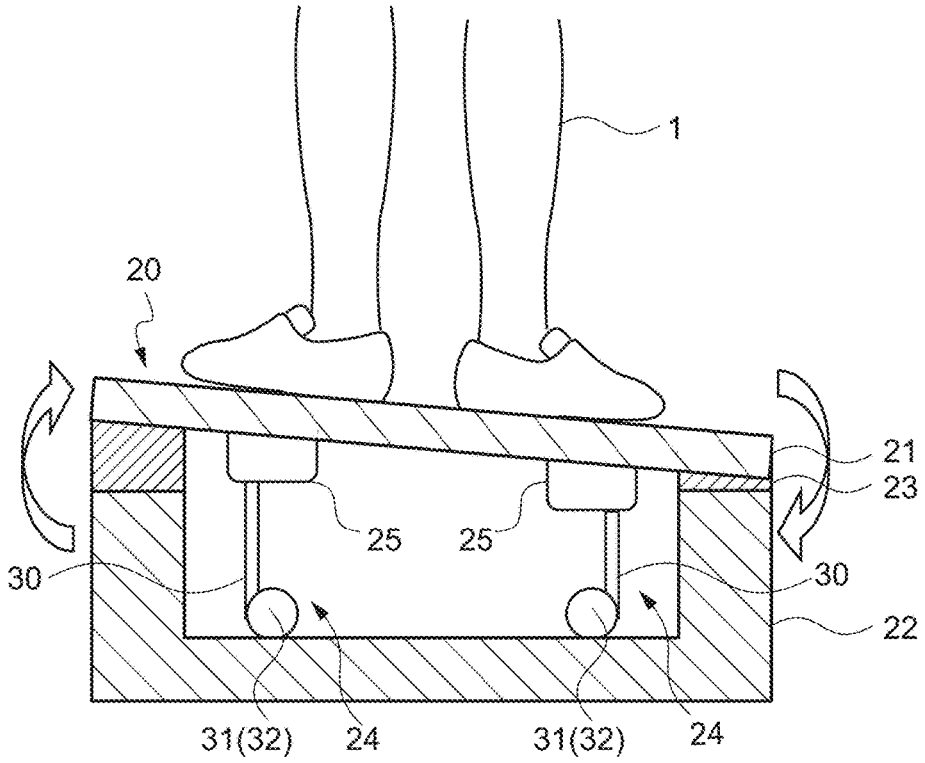

FIGS. 4A and 4B are schematic diagrams showing an operation example of the tactile presentation apparatus. FIGS. 4A and 4B schematically show configurations simplifying the tactile presentation apparatus 20.

In FIG. 4A, all the motors 32 pull the top plate portion 21 simultaneously. In this case, each damper 23 contracts by an amount of pulling, and the top plate portion 21 sinks as a whole. Next, when lowering torque of all the motors 32 (or stopping all the motors 32), the top plate portion 21 is pushed back due to the restoring forces of the dampers 23. Repeating such an operation can vibrate the top plate portion 21 upward and downward.

Simultaneously pulling towing all the motors 32 using control signals at a synchronized time in this manner can generate an up and down vibration.

In FIG. 4B, the right and left motors 32 in the figure alternately pull the top plate portion 21. For example, torque of the left motor 32 is reduced (or stopped) when the right motor 32 pulls the top plate portion 21 as shown in FIG. 4B. In this case, the right damper 23 contracts and the left damper 23 pushes up the top plate portion 21. As a result, the top plate portion 21 is tilted rightward.

In contrast, torque of the right motor 32 is reduced (or stopped) when the left motor 32 pulls the top plate portion 21. As a result, the top plate portion 21 is tilted leftward.

Alternately pulling the left/right (front/rear) of the top plate portion 21 in this manner can present a vibration tilted leftward/rightward (forward/rearward).

Moreover, continuously pulling the top plate portion 21 can keep it tilted. In this case, a control signal to generate constant torque is continuously output to the motor 32 that pulls the top plate portion 21.

This allows presentation of the state tilted forward, rearward, leftward, or rightward.

It should be noted that two or more motors 32 may be used as a pair for tilting the top plate portion 21. Specifically, pairs each consisting of two motors 32 combining one of the front and rear motors 32 and one of the left and right motors 32 are configured and the respective pairs are caused to alternately pull the top plate portion 21. This provides a state tilted to the front left (rear right) or a state tilted to the front right (rear left), for example.

Vibrating the top plate portion 21 in this manner can present to the user 1, for example, an impact of an explosion scene or the like displayed on the display 10 or a vibration sensation appropriate for a music piece, a sound, or the like.

Moreover, tilting the top plate portion 21 can give an illusion as if the body loses balance. Presenting such a tilt of the top plate portion 21 in conjunction with a video on the display 10 as a cross-modal interaction can give the user 1 an illusion that is the feel of acceleration when an automobile or train starts to run, for example.

[Configuration of Reels] FIGS. 5A and 5B are schematic diagrams for describing properties of the reel 31 for winding the wire 30. FIG. 5A schematically shows the reel 31 winding the wire 30. Here, the wire 30 is fixed to a fixing position P and a counter-clockwise rotation of the reel 31 as the normal rotation winds the wire 30. Moreover, a clockwise rotation of the reel 31 as the opposite rotation releases the wire 30.

The normal rotation and the opposite rotation of the motor 32 are repeated in such a manner for vibrating the top plate portion 21. At that time, the rotation amount of the normal rotation of the motor 32, i.e., the amount of winding the wire 30 corresponds to an amplitude of the vibration. Thus, the amplitude A is represented as a product ($R \times \omega \times t$) of a radius R of the reel 31, an angular velocity $\omega$ (rotation velocity) of the motor 32, and a rotation time t.

The reciprocal of the rotation time t among them is a frequency f of the vibration. Thus, an amplitude A is represented as $A = R \times \omega / f$. In a case of presenting the vibration, the amplitude A is thus inversely proportional to the frequency f (presentation frequency) to drive the motor 32.

FIG. 5B shows a schematic graph showing a relationship between the amplitude A and the frequency f of a circular reel with a constant radius R as the solid line. As shown in the graph, the amplitude A (amount of winding) decreases in inverse proportion as the frequency f increases in a case where the reel has the constant radius R.

In a case of using the simple circular reel in this manner, there is a possibility that the amplitude of the vibration that can be presented, i.e., intensity of the vibration decreases and it becomes difficult to suitably present higher-frequency vibration as the frequency f of the vibration increases.

FIGS. 6A and 6B are schematic diagrams showing a configuration example of the winding reel.

In the present embodiment, the reel 31 is configured so that the amount of winding the wire 30 decreases as the rotation amount of the motor 32 increases. Specifically, a spiral reel 31 whose radius R at a portion for winding the wire 30 gradually decreases is used.

For example, FIG. 6A shows a spiral reel 31*a* configured using the Archimedean spiral. A winding groove shape of the reel 31*a*, which constitutes the respective steps, is the Archimedean spiral in a planar view.

Moreover, FIG. 6B shows a spiral reel 31*b* configured using a logarithmic spiral. A winding groove shape of the spiral reel 31*b*, which constitutes the respective steps, is the logarithmic spiral in a planar view. In addition, a spiral reel using a parabolic spiral, a hyperbolic spiral, or the like may be used.

As to those spiral reels 31, the wire 30 is fixed using a portion with the maximum radius R as the fixing position P. The wire 30 is wound so that the radius gradually decreases from this fixing position P. This allows a great reduction of a difference between the amount of winding at a higher frequency f and the amount of winding at a lower frequency f.

Using the spiral reel 31 as described above can make frequency characteristics related to the amplitude of the reel 31 closer to characteristics (broken-line graph in FIG. 5B) that achieves a constant amplitude A irrespective of the frequency f.

It should be noted that the shape of the reel 31 is selected as appropriate in accordance with properties of the motor 32, for example. Moreover, the amplitude of the control signal and the like may be adjusted in accordance with the shape of the reel 31. This allows accurate reproduction of a vibration pattern specified by a force sense control file.

[Operation of Tactile Controller]

Figure 7:
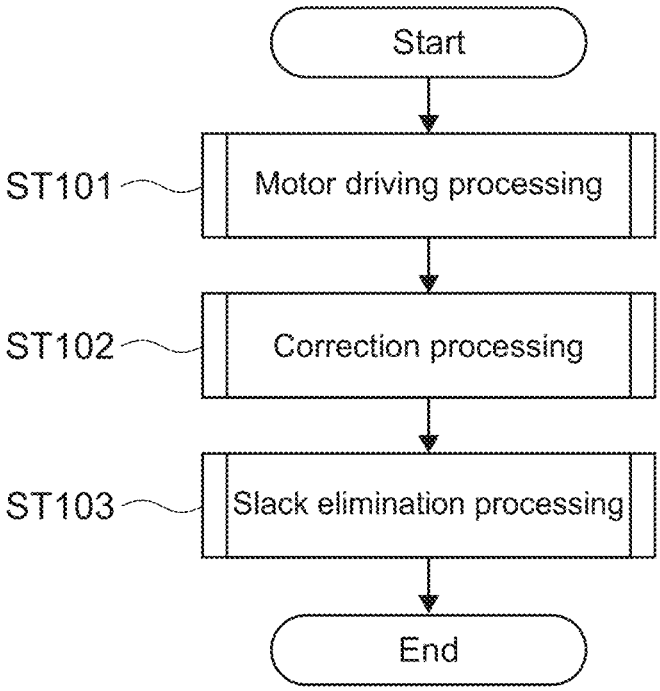
FIG. 7 A flowchart showing a basic operation example of a tactile controller.

FIG. 7 is a flowchart showing a basic operation example of the tactile controller 40. The processing shown in FIG. 7 is loop processing repeated during the operation of the tactile controller 40 (tactile presentation system 100), for example.

The tactile controller 40 executes motor driving processing to drive the motors 32 (Step 101). Next, the tactile controller 40 executes correction processing to correct control signals in view of a result of the motor driving processing (Step 102). Then, the tactile controller 40 executes slack elimination processing for eliminating slack of the wires 30 (Step 103).

In FIG. 7, the motor driving processing, the correction processing, and the slack elimination processing are repeated as a series of processing. The present technology is not limited thereto, and the respective processing may be independently executed at different times.

For example, the correction processing and the slack elimination processing may be executed at an initial start, a scene change time of the content, or the like. Alternatively, the correction processing and the slack elimination processing may be executed in accordance with an instruction from the user 1.

Hereinafter, the motor driving processing, the correction processing, and the slack elimination processing will be each described specifically.

[Motor Driving Processing]

Figure 8:
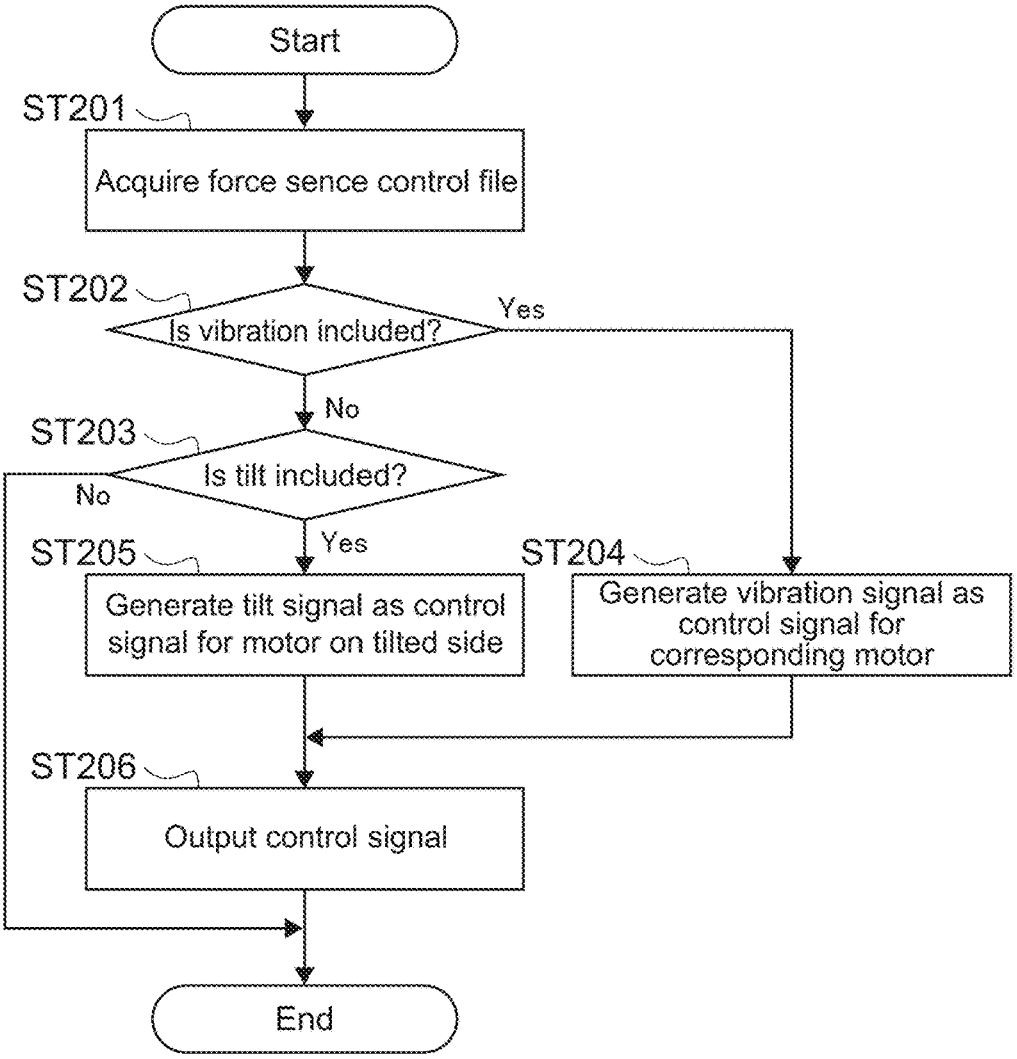
FIG. 8 A flowchart showing an example of motor driving processing.

FIG. 8 is a flowchart showing an example of the motor driving processing.

First of all, the signal control unit 41 acquires a force sense control file (Step 201). Specifically, the signal control unit 41 reads the force sense control file output from the data output unit 52 of the system controller 50.

Next, the signal control unit 41 determines whether or not the force sense control file includes an instruction (vibration information) to vibrate the top plate portion 21 (Step 202). In a case where the signal control unit 41 determines that the force sense control file does not include the vibration information (No in Step 202), the signal control unit 41 determines whether or not the force sense control file includes an instruction (tilt information) to tilt the top plate portion 21 (Step 203). In a case where the signal control unit 41 determines that the force sense control file does not include the tilt information (No in Step 203), the motor driving processing ends without generating any control signals for controlling the motors 32.

In Step 202, in a case where the signal control unit 41 determines that the force sense control file includes the vibration information (Yes in Step 202), the signal control unit 41 generates vibration signals that are control signals to vibrate the top plate portion 21 (Step 204).

The vibration signals are, for example, signals to fluctuate voltages applied to the motors 32. It can also be said that these are signals to fluctuate torque of the motors 32 and signals to fluctuate the amount of pulling (amplitude) by which the motors 32 pull the top plate portion 21.

The signal control unit 41 generates vibration signals respectively corresponding to the motors 32 so that the top plate portion 21 vibrates in a vibration pattern specified by the force sense control file.

Here, a case of vibrating the top plate portion 21 by using the motors 32*a* to 32*d* (drive units 24*a* to 24*d*) in the tactile presentation apparatus 20 shown in FIGS. 3A and 3B will be described.

For example, in a case where a vibration pattern (see FIG. 4A) to vibrate the top plate portion 21 upward and downward is specified, identical vibration signals are generated for all the motors 32*a* to 32*d*. These vibration signals cause the respective motors 32*a* to 32*d* to pull the top plate portion 21 by the same length at the same time. The top plate portion 21 can be thus vibrated upward and downward.

Moreover, for example, in a case where a vibration pattern (see FIG. 4B) to vibrate the top plate portion 21 tilted leftward and rightward is specified, vibration signals whose phases are offset by 180 degrees are generated for the motors 32*a* and 32*b*. In a case of vibrating the top plate portion 21 tilted forward and rearward similarly, vibration signals whose phases are offset by 180 degrees are generated for the motors 32*c* and 32*d*. These vibration signals cause the left/right (or the front/rear) of the top plate portion 21 to be alternately pulled. The top plate portion 21 can be thus vibrated tilted leftward/rightward (or forward/rearward).

Moreover, it is assumed that the vibration pattern is a pattern to alternately tilt the top plate portion 21 to the front left or the rear right. In this case, vibration signals corresponding to the motor 32*a* and the motor 32*c* and vibration signals corresponding to the motor 32*b* and the motor 32*d* are generated as signals whose phases are offset from each other by 180 degrees. Moreover, with the pattern to alternately tilt the top plate portion 21 to the front right or the rear left, the corresponding vibration signals are generated by changing one of the above-mentioned pairs to the other.

In addition, for example, a vibration pattern in which each of the front, rear, left, and right motors 32*a* to 32*d* vibrates alone may be used. In this case, a vibration signal for the motor 32 corresponding to a specified direction is generated.

When these vibration signals are generated, the vibration signals are output to the amplifier 35 (Step 206). Then, the corresponding motors 32 are driven on the basis of the vibration signals amplified by the amplifier 35.

In this manner, in the present embodiment, the signal control unit 41 selects motors 32 corresponding to the vibration pattern from among the respective motors 32 (drive units 24) and vibrates the vibration pattern in accordance with the amount of pulling by which the selected motors 32 pull the top plate portion 21.

Accordingly, the top plate portion 21 can be vibrated in various vibration patterns. Thus, a wide variety of tactile senses can be presented to the user 1.

Figure 9:
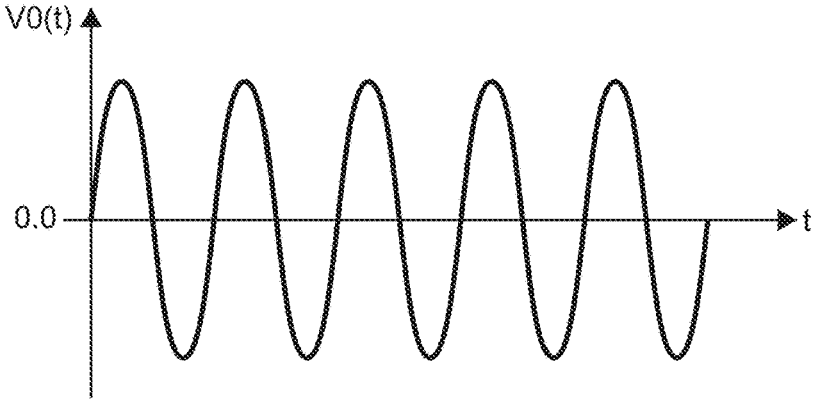
FIG. 9 A graph showing an example of an original signal indicating a vibration waveform.

FIG. 9 is a graph showing an example of an original signal indicating a vibration waveform. FIG. 9 shows a graph of an original signal $V0(t)$ representing the vibration waveform (amplitude) as a voltage. The vertical axis of the graph indicates a voltage and the horizontal axis indicates a time. Moreover, the waveform of the graph is the vibration waveform.

Here, the original signal $V0(t)$ is a sine wave of a predetermined frequency and vibrates at a constant amplitude using a zero-voltage state as a center.

An input control file thus includes data about the original signal $V0(t)$ representing a vibration waveform to vibrate the top plate portion 21. Therefore, the original signal $V0(t)$ can be said to be a force sense input signal representing a tactile sense (force sense) presented to the user 1.

FIGS. 10A and 10B are schematic diagrams for describing the vibration signal.

FIG. 10A shows a graph of a vibration signal V1(*t*) generated on the basis of the original signal V0(*t*) shown in FIG. 9. The vertical axis of the graph indicates a voltage and the horizontal axis indicates a time. The vibration signal V1(*t*) is a signal specifying the voltage of the motor 32. Specifying the voltage of the motor 32 in advance can achieve feed-forward control to control the rotational operation of the motor 32 in advance.

Moreover, FIG. 10B schematically shows the position of the top plate portion 21 that changes in accordance with the vibration signal V1(*t*).

Here, the vibration signal V1(*t*) will be described exemplifying a case where the top plate portion 21 vibrates in the upper and lower directions (Z-direction). Moreover, the position of the lower surface of the top plate portion 21 is considered as the position of the top plate portion 21.

FIG. 10B respectively shows a position (Zmax) at which the top plate portion 21 is located highest, a position (Zmin) at which the top plate portion 21 is located lowest, and a position (Zref) that is the middle between Zmax and Zmin. The range of Zmax to Zmin is a range in which the top plate portion 21 can move by elastically deforming the dampers 23, i.e., a range of movement of the top plate portion 21.

In the example shown in FIG. 10A, the vibration signal V1(*t*) to drive the motor 32 in a positive voltage range is generated on the basis of the original signal V0(*t*). That is, V1(*t*) is a signal obtained by offsetting V0(*t*) in a positive direction. An offset value (Vofs) at this time is, for example, set so that the voltage is equal to or larger than zero at all points of V1(*t*).

This causes the voltage applied to the motor 32 to be constantly positive. As a result, the motor 32 is controlled to constantly perform a normal rotation, which generates torque only in the direction of winding the wire 30.

It should be noted that the amplitude of V1(*t*) does not necessarily need to equal the amplitude of V0(*t*) and may be adjusted as appropriate.

In FIG. 10A, an offset value Vofs is set so that the minimum value of the vibration signal V1(*t*) becomes zero. Moreover, the maximum value of the vibration signal V1(*t*) is set to a voltage at which the amount of pulling becomes maximum in the range of movement of the top plate portion 21, for example.

The motor 32 does not rotate when V1(*t*) is minimum (voltage=0), for example. Thus, the position of the top plate portion 21 is Zmax. When V1(*t*) increases, the torque of the motor 32 also increases, the top plate portion 21 is pulled, and the damper 23 contracts. The damper 23 is the most contracted in the range of movement when V1(*t*) becomes maximum. Thus, the position of the top plate portion 21 is Zmin.

Moreover, the torque of the motor 32 decreases when V1(*t*) decreases after V1(*t*) becomes maximum. At that time, the damper 23 starts to push up the top plate portion 21 due to the restoring force. Thus, the position of the top plate portion 21 increases during the process in which V1(*t*) decreases. Then, the position of the top plate portion 21 returns to Zmax when V1(*t*) becomes minimum.

It should be noted that the restoring force of the damper 23 can be higher than the torque of the motor 32 in a low-voltage range, depending on properties of the damper 23 and the motor 32. In this case, the damper 23 can return to the original size (position of the top plate portion 21 becomes Zmax) before V1(*t*) becomes minimum.

In such a case, V1(*t*) may be associated with the position of the top plate portion 21 in a one-to-one relationship by increasing the offset value Vofs, for example.

The motor 32 rotates in the direction of winding the wire 30 by offsetting the original signal in a positive-voltage range as shown in FIG. 10A. This allows suppression of slack of the wires 30. Moreover, keeping such a control can eliminate the slack of the wires 30 over time.

In this manner, the vibration signal shown in FIG. 10A can be said to be a control signal for preventing slack (loose) of the wire 30.

FIG. 11 is a graph showing another example of a voltage signal to vibrate the top plate portion.

FIG. 11 shows a graph of the vibration signal V1(*t*) to drive the motor 32 in a positive-voltage and negative-voltage range. In this case, an offset value in generating a vibration signal V1(*t*) from an original signal V0(*t*) is set so that trough parts of the vibration waveform are at negative voltages.

Thus, the offset value Vofs does not necessarily need to be set to prevent the voltage from becoming negative.

For example, the motor 32 performs an opposite rotation in a range in which V1(*t*) has a negative voltage. For example, the wire can be released by a constant amount when the motor 32 performs an opposite rotation. This enables the damper 23 to return to the original size without adding an extra force (e.g., a force that causes the motor 32 to spin the wrong way via the wire 30) to the damper 23.

The velocity to push up the top plate portion 21 can be prevented from lowering by early reducing the force added to the damper 23 in this manner when the damper 23 restores slowly, for example. This allows appropriate expression of even a high-frequency vibration.

Moreover, the offset value Vofs for the vibration signal may be set in accordance with a vibration frequency.

For example, as described above with reference to FIGS. 5A and 5B, the winding time decreases as the frequency increases in the configuration to wind the wire 30 through the reel 31. Therefore, assuming a constant winding velocity (angular velocity ω), the amount of winding the wire 30, i.e., the amplitude decreases as the frequency increases.

For example, increasing Vofs increases the torque of the motor 32 and can increase the velocity to wind the motor 32. Therefore, Vofs is set to increase as the vibration frequency increases. This causes the winding velocity to increase at a higher frequency. Thus, a decrease in the amount of winding can be suppressed.

FIGS. 12A and 12B are schematic diagrams showing a generation example of the vibration signal, using an audio signal as the original signal. FIG. 12A shows a graph representing the audio signal. Here, it is assumed that the audio signal included in the audio file is used as vibration information of the force sense control file. That is, the audio signal is used as the original signal V0(*t*).

FIG. 12B shows a graph of the vibration signal V1(*t*) generated from the audio signal shown in FIG. 12A.

In a case where the audio signal becomes the original signal V0(*t*), the vibration signal V1(*t*) is generated by performing signal processing to eliminate negative voltage parts of the audio signal.

In the example shown in FIG. 12B, the offset value Vofs that is a constant amount is added to the audio signal so as to perform driving at positive voltages only. Moreover, the amplitude of the audio signal is normalized to be equal to or lower than a predetermined threshold voltage Vmax. The threshold voltage Vmax is, for example, a voltage capable of pulling the wire 30 so that the position of the top plate portion 21 becomes Zmin.

This allows expression of a vibration according to the audio signal.

It should be noted that in the method shown in FIG. 12B, a region in which V1(*t*) increases again without dropping to zero is generated. In this region, the top plate portion 21 is clipped in half way without returning to the original position.

Therefore, for example, normalization processing to bend negative-voltage parts of the waveform of the audio signal to positive-voltage parts, using a voltage=0 as a boundary, can prevent the top plate portion 21 from being clipped. This allows an increase in amplitude that can be expressed by the top plate portion 21. Thus, dynamic tactile presentation can be realized.

Referring back to FIG. 8, in a case where the signal control unit 41 determines in Step 203 that the force sense control file includes the tilt information (Yes in Step 203), the signal control unit 41 generates tilt signals that are control signals to tilt the top plate portion 21 (Step 205).

The tilt signals are, for example, signals to keep voltages applied to the corresponding motors 32 constant. These can also be said to be signals to keep the amount of pulling (amplitude) by which the motors 32 pull the top plate portion 21 constant by making torque of the motors 32 constant.

The signal control unit 41 generates a tilt signal corresponding to the motor 32 as a target so that the top plate portion 21 is kept in a tilted attitude specified by the force sense control file.

Here, a case of tilting the top plate portion 21 by the use of the motors 32*a* to 32*d* (drive units 24*a* to 24*d*) in the tactile presentation apparatus 20 shown in FIGS. 3A and 3B will be described.

For example, in a case where a tilted attitude in which the top plate portion 21 is tilted rightward is specified, a tilt signal for the motor 32*a* that pulls the right side of the top plate portion 21 is generated. Similarly, tilt signals to drive the motor 32*b*, the motor 32*c*, and the motor 32*d* are respectively generated for tilting the left side, the front side, and the rear side of the top plate portion 21. This enables the top plate portion 21 to be tilted forward, rearward, leftward, or rightward.

Moreover, for example, in a case of tilting the top plate portion 21 to the front left, tilt signals for the motor 32*a* and the motor 32*c* are generated. Similarly, in a case of tilting the top plate portion 21 to the rear left, the front right, the rear right, or the like, tilt signals are generated for a pair that pulls the motors 32 on the tilted side.

Moreover, the use of three or more motors 32 can achieve an arbitrary tilt. In this case, a tilt signal to specify the amount of pulling is generated for each motor 32.

When these tilt signals are generated, the tilt signals are output to the amplifier 35 (Step 206). Then, the corresponding motors 32 are driven on the basis of the tilt signal amplified by the amplifier 35.

In this manner, in the present embodiment, the signal control unit 41 selects the motors 32 of the respective motors 32 (drive units 24), which correspond to the tilted attitude, and keeps the amount of pulling by which the selected motors 32 pull the top plate portion 21 a value according to the tilted attitude.

This enables the top plate portion 21 to be tilted in various directions. Thus, a wide variety of tactile senses can be presented to the user 1.

FIG. 13 is a schematic diagram for describing the tilt signal.

FIG. 13A shows a graph of the tilt signal V2(*t*). The vertical axis of the graph indicates a voltage and the horizontal axis indicates a time. The tilt signal V2(*t*) is a signal specifying the voltage of the motor 32. Here, it is assumed that a single motor 32 pulls the top plate portion 21. In this case, a control signal for the motor 32 other than the motors 32 that pull the top plate portion 21 is a signal whose voltage takes a constant value (typically 0).

Moreover, FIG. 13B schematically shows the position of the top plate portion 21 pulled by the motor 32 driven in accordance with the tilt signal V2(*t*). Here, it is assumed that the tilt signal V2(*t*) is input to the right motor 32 in the figure.

As to the tilt signal V2(*t*) shown in FIG. 13A, the voltage is set to be zero until a time t1. The position of the top plate portion 21 in this period is Zmax. The voltage increases until the time t1 and the voltage becomes maximum at a time t2. The maximum value of the voltage at this time is, for example, a value with which the position of the top plate portion 21 becomes Zmin. Therefore, the right side of the top plate portion 21 is located lowest at the time t2. It should be noted that the left side of the top plate portion 21 does not move from the position Zmax.

The voltage value is kept maximum in a period of the time t2 to a time t3. The top plate portion is kept tilted rightward as shown in FIG. 13 during this period. The voltage is lowered after the time t3. Then, the voltage=0 at a time t4. Therefore, the top plate portion 21 returns to the horizontal state after the time t4.

For example, reducing the time of the period t1 to t2 to tilt the top plate can express a rapid floor change. This can express the feel of acceleration sensation or the feel of deceleration along with sudden start or sudden braking.

In addition, a velocity to return the top plate portion 21 to the original position, a tilt angle of the top plate portion 21, or the like can be set as appropriate.

[Correction Processing]

Figure 14:
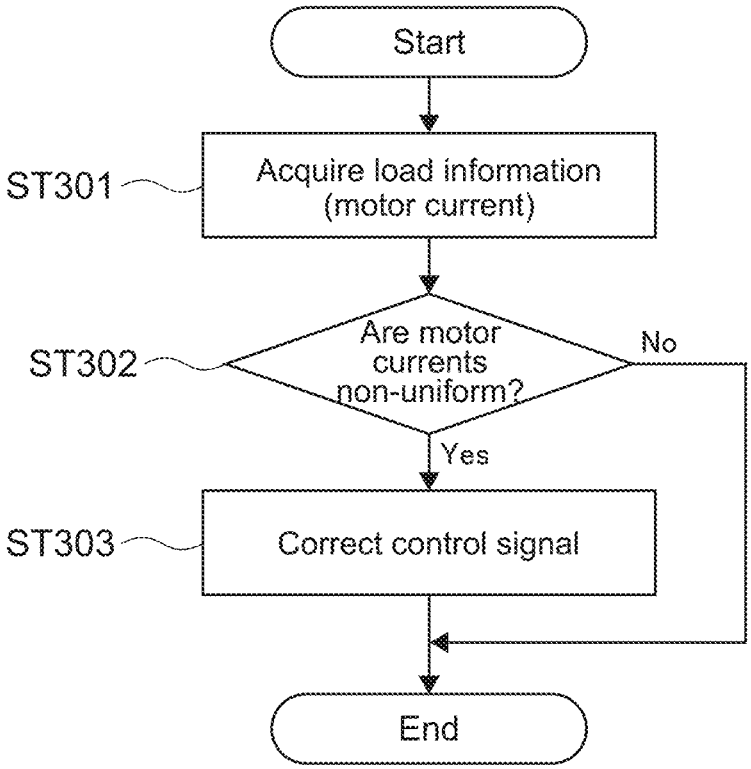
FIG. 14 A flowchart showing an example of correction processing.

FIG. 14 is a flowchart showing an example of the correction processing.

The correction processing corrects a control signal (vibration signal or tilt signal) output to the motor 32 on the basis of the load information representing the load applied to the motor 32. This correction is reflected to, for example, next motor driving processing (more specifically, processing of generating the control signal in Step 204 or 205 of FIG. 8).

Here, processing of correcting the control signal in accordance with the tilt of the top plate portion 21 will be described as an example of the correction processing.

First of all, the calibration processing unit 42 acquires load information (Step 301). Here, it is assumed that the load information is a detection result of the current sensor 36 described above with reference to FIG. 2.

In the tactile presentation apparatus 20, for example, the amplifier 35 amplifies the control signal output in Step 206 of FIG. 8 and inputs the amplified control signal to each motor 32. The current sensor 36 detects a motor current flowing through the motor 32 to which the amplified control signal is input in this manner. Then, the calibration processing unit 42 reads a detection result of the current sensor 36 (a measurement value of the motor current).

Next, the calibration processing unit 42 determines whether or not the motor currents of the respective motors 32 are non-uniform (Step 302).

For example, observing a change in motor current can estimate by how much force and on which place of the top plate portion 21 the user 1 is stepping. That is, the motor 32 and the current sensor 36 also function as a stepping sensor that detects stepping of the user 1.

The determination as to whether or not the motor currents are non-uniform is processing of determining a tilt of the top plate portion 21 due to stepping (or the standing position) of the user 1.

Figure 15:
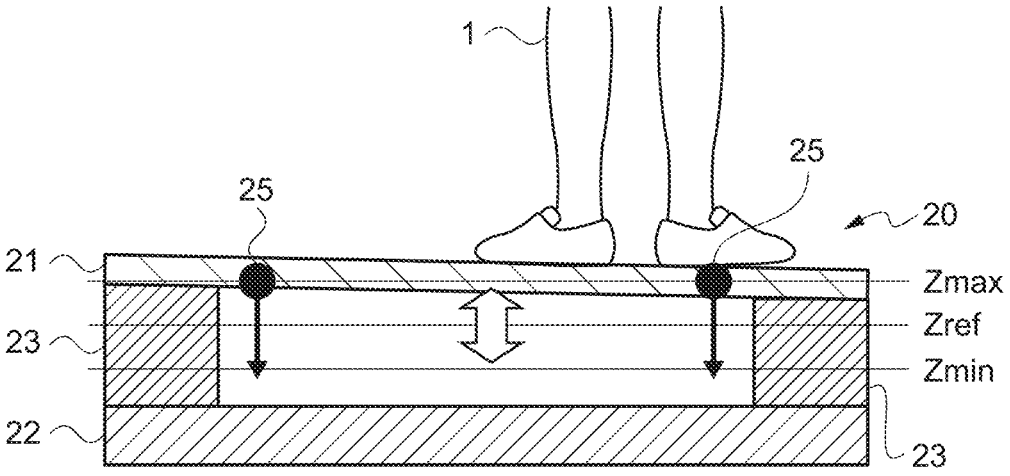
FIG. 15 A schematic diagram describing correction processing according to a tilt of the top plate portion.

FIG. 15 is a schematic diagram describing correction processing according to the tilt of the top plate portion 21.

For example, when the user 1 is standing at an end of the top plate portion 21, the damper 23 (in the figure, the right damper 23) on the standing side of the user 1 is more contracted than the damper 23 opposite to this damper 23. That is, the top plate portion 21 is tilted.

It is assumed that the same torque is generated by adding the same voltage to each motor 32 in this state. In this case, the damper 23 is already contracted on the standing side of the user 1. Therefore, the amount of pulling with the same force is smaller than that on the opposite side. That is, the load applied to the motor 32 on the standing side of the user 1 is larger than that on the opposite side. As a result, the motor 32 that pulls the tilt side of the top plate portion 21 has a larger motor current, for example, in a case of driving each motor 32 at the same voltage.

Therefore, the tilt of the top plate portion 21 can be detected by comparing values of motor currents of the respective motors 32 and checking the motor 32 having the load applied (motor 32 with a higher motor current).

It should be noted that the attitude of the top plate portion 21 may be estimated from a detection result of an attitude sensor, for example, provided in the top plate portion 21.

For example, as to the four motors 32 (see FIG. 2) that pull the front, rear, left, or right of the top plate portion 21, when even one of the motors 32 has a higher load (higher motor current), the top plate portion 21 is considered to be tilted on the side of this motor 32. In this manner, in a case where it is determined that the motor currents are non-uniform (Yes in Step 302), processing of correcting the control signal is executed (Step 303). It should be noted that in a case where it is determined that the motor currents are uniform (Yes in Step 302), the processing of correcting the control signal is not executed and the correction processing ends.

In Step 303, the calibration processing unit 42 recalculates an output to each motor 32 (e.g., a voltage value applied to each motor 32) by using the motor current of each motor 32 that is the load information. Then, parameters according to the control signal (input waveform) are adjusted. The parameters according to the control signal are, for example, an offset value Vofs and an amplitude described above with reference to FIGS. 10A and 10B, etc.

Specifically, the control signal is corrected on the basis of the load information so that loads of the motors 32 of the plurality of drive units 24 are equal.

Offset values Vofs for the control signals of the other motors 32 are adjusted so that loads similar to the load of the motor 32 having the higher load (motor 32 on the tilt side) are applied to the other motors 32, for example. Moreover, the amplitude of each control signal for each motor 32 is adjusted to be capable of vibrating at a similar amplitude.

This enables the top plate portion 21 to uniformly vibrate even when the standing position of the user 1 deviates. Thus, the vibration pattern can be appropriately expressed.

FIGS. 16A and 16B are schematic diagrams describing correction processing depending on the load applied to the top plate portion 21.

Here, the processing of correcting the control signal in accordance with the load applied to the top plate portion 21, i.e., the weight of the user 1 standing on the top plate portion 21 or the number of users 1 will be described. This processing is, for example, processing dynamically executed in accordance with the load applied to the top plate portion 21.

FIG. 16A is a schematic diagram showing a state in which the top plate portion 21 is displaced toward the base portion 22 due to the load. When the load is applied to the top plate portion 21, the damper 23 contracts and the top plate portion 21 sinks. Here, a displacement amount of the top plate portion 21 with respect to the position of the top plate portion 21 (Zmax) in a no-load state is denoted as Δ.

The displacement amount Δ increases as the load applied to the top plate portion 21 increases. That is, the amount of contraction of the damper 23 increases as the load applied to the top plate portion 21 increases.

Moreover, it is necessary to further contract the already contracted damper 23 in order to pull the top plate portion 21 with the added load more downward. Therefore, the torque of the motor 32 required for pulling the top plate portion 21 increases as the load applied to the top plate portion 21 increases.

In the correction processing of the control signal depending on the load, the load applied to the top plate portion 21 is first estimated on the basis of the load information (motor current). For example, the motor current of each motor 32 is compared with the motor current in the no-load state. Then, the magnitude of the load is estimated on the basis of an amount of increase of the motor current with respect to the no-load state.

It should be noted that the load applied to the top plate portion 21 may be estimated on the basis of a detection result of a pressure sensor, for example, provided in the top plate portion 21.

Next, the offset value Vofs of the control signal for each motor 32 is set in accordance with the estimated load. FIG. 16B shows a graph showing the control signal (vibration signal V1(*t*)) for which Vofs is adjusted. For example, Vofs is set to increase as the load increases.

This causes the torque to increase as the entire signal. Thus, the top plate portion 21 can be appropriately vibrated also after the damper 23 is contracted.

It should be noted that correction to shift the entire signal so as to increase the signal level is executed in accordance with the load value as to the tilt signal to cause a tilt.

In this manner, the calibration processing unit 42 estimates the load applied to the top plate portion 21 on the basis of the load information and corrects the control signal so as to increase the force by which the motors 32 pull the top plate portion 21 as the load increases.

For example, in a case where a plurality of users 1 is on the top plate portion 21, there is a possibility that a sufficient magnitude of vibration or tilt cannot be caused with the control signal without any correction. Therefore, a similar vibration or tilt can be expressed irrespective of the magnitude of the load applied to the top plate portion 21 by changing the magnitude of the movement in accordance with the load.

Moreover, processing of changing the control depending on a standing position of the user 1 may be executed as the processing of correcting the control signal.

For example, when the user 1 stands on an end of the top plate portion 21, an amount of operation (vibration amplitude or tilt angle) or the like of the top plate portion 21 is set to be smaller for safety in case where the user 1 loses balance. The standing position of the user 1 is estimated on the basis of a tilt amount of the top plate portion 21, for example. In this case, for example, when the tilt amount is larger than a constant threshold, it is determined that the user 1 is positioned at the end of the top plate portion 21. Alternatively, the standing position of the user 1 may be estimated on the basis of a detection result of the pressure sensor.

In a case where it is determined that the user 1 is positioned at the end of the top plate portion 21, the control signal is corrected to reduce the operation amount of the top plate portion 21, i.e., the amount of pulling by the motor 32. Specifically, the amplitude of the control signal is set to be smaller. Alternatively, the offset value for the control signal is set to be smaller.

In this manner, the calibration processing unit 42 estimates a position of the user 1 on the top plate portion 21 on the basis of the load information. Then, the control signal is corrected to reduce the amount of pulling by which the motors 32 pull the top plate portion 21 when the position of the user 1 is the end of the top plate portion 21.

This allows prevention of the situation where the user 1 falls from the top plate portion 21. Thus, it can enhance the safety.

[Slack Elimination Processing]

FIG. 17 is a flowchart showing an example of the slack elimination processing.

In the slack elimination processing, the motor 32 is driven to eliminate slack of the wire 30.

First of all, the signal control unit 41 determines whether or not the wire 30 is slack (Step 401). In this determination, the signal control unit 41 determines whether or not a period of outputting a control signal such as a vibration signal and a tilt signal exceeds a predetermined threshold, for example.

In the configuration to wind the wires 30, the wires of the other motors 32 are expected to be slack when a time of continuously driving a certain motor 32 exceeds a constant time. For example, keeping winding the wire 30 connected to the top plate portion 21 in one direction can make the wires of the motors 32 other than the wound motor 32 slack.

Therefore, determining an output period of a currently output control signal can detect a state in which slack of the wires 30 is generated at a high possibility.

It should be noted that in contrast to the above-mentioned determination processing, the motor 32 rotates freely, which can make the wire 30 slack, also when the motor 32 is not driven for a long time. Thus, whether or not the wire 30 is slack may be determined on the basis of the time for which the motor 32 is halted.

Alternatively, the slack of the wire 30 may be directly detected by rotating the halted motor 32 and calculating a load applied to the motor 32 on the basis of its motor current.

In a case where the signal control unit 41 determines that the wire 30 is slack, the signal control unit 41 generates a control signal to eliminate the slack of the wire 30 and output the control signal to each motor 32 (Step 402). Specifically, the signal control unit 41 generates a control signal to perform a normal rotation of the motor 32 at low torque to halt the top plate portion 21 for a constant time. The signal control unit 41 outputs this low-torque control signal in order from the not driven motor 32.

Accordingly, as to the motor 32 whose wire 30 is slack, the reel 31 winds the wire 30 so as to eliminate the slack of the wire 30.

In this manner, the signal control unit 41 rotates the motor 32 so as to eliminate the slack of the wire 30. This prevents the situation where the time to pull the top plate portion 21 is delayed. Thus, the vibration or attitude can be changed at an appropriate time.

Moreover, the slack elimination processing may be executed as calibration at the start of activation of the tactile presentation apparatus 20. In this case, each wire 30 is wound to a position where it is not slack at the start of the operation of the tactile presentation apparatus 20 so as to compensate for slack or the like generated due to degradation of the wires 30 over time.

It should be noted that positions of the motors 32 when rotating so as to prevent slack of the wires 30 may be set, for example, as initial positions of the motors 32 in a case where the rotation positions of the motors 32 can be controlled, for example, as will be described later.

Moreover, the slack elimination processing may be executed when the load applied to the top plate portion 21 or the like has suddenly changed. For example, when the user 1 gets on the top plate portion 21 brutally or when the user 1 jumps on the top plate portion 21, there is a possibility that the top plate portion 21 suddenly sinks, which makes the wires 30 slack. Therefore, processing of rotating the motors 32 at low torque so as to prevent slack of the wires 30 is executed, for example, when a sudden change in load has been detected on the basis of the load information (detection result of the current sensor 36 or the pressure sensor). This allows presentation of a vibration or the like at an appropriate time irrespective of behaviors of the user 1.

[Position Control of Motor]

In the above description, the control signals to specify voltages applied to the motors 32 have been mainly described. For example, in a case of performing feedback control of the motors 32 by the use of a potentiometer, an encoder, or the like, the amplitude of the control signal may be handled as a position command value of position control (e.g., PID control), not a voltage command value.

In this case, the control signal is a signal specifying the rotation amount of the motor 32.

FIGS. 18A and 18B are schematic diagrams showing an example of position control of the motor. The graphs shown on the upper side of FIGS. 18A and 18B show a vibration signal R (t) specifying the rotation amount of the motor 32.

Here, the rotation amount of the motor 32 is, for example, an amount by which the rotational shaft of the motor 32 (reel 31) rotates from a predetermined reference position. Therefore, the rotation amount increases as the rotated angle and the r.p.m. increase.

In FIGS. 18A and 18B, the reference position of this rotation amount is different.

In FIG. 18A, a middle position (Zref) of the range of movement of the top plate portion 21 is set as the reference position of the rotation amount. In this case, as shown on the lower side of FIG. 18A, the vibration signal R(t)=0 represents a state in which the position of the top plate portion 21 is Zref that is the reference position. Moreover, for example, the minimum value and maximum value of the vibration signal R(t) respectively represent a state in which the top plate portion 21 is at the position Zmax on the uppermost side of the range of movement and a state in which the top plate portion 21 is at the position Zmin on the lowermost side.

This method enables intuitive representation of a vibration or the like as viewed from a center position Zref of the range of movement. For example, this method enables the use of the vibration signal R(t) in place of the original signal without offsetting the original signal.

In FIG. 18B, the position (Zmax) on the uppermost side of the range of movement of the top plate portion 21 is set as the reference position of the rotation amount. In this case, as shown on the lower side of FIG. 18B, the vibration signal R(t)=0 represents a state in which the position of the top plate portion 21 is Zmax that is a default position. Moreover, for example, the maximum value of the vibration signal R(t) represents a state in which the top plate portion 21 is at the position Zmin on the lowermost side of the range of movement.

This method enables representation of a vibration using the default position Zmax of the top plate portion 21 as a starting point. In this case, the vibration signal R(t) is calculated by offsetting the original signal so as not to generate negative portions of the position control.

It should be noted that even in a case of specifying the rotation amount of the motor 32 (rotation position), the wires 30 may be released at a velocity higher than the restoring velocity of the damper 23, depending on the velocity of moving the motors 32. In such a case, a constant upper limit may be set to the rotation velocity in the release direction (i.e., the direction of opposite rotation in which the rotation amount decreases) so as to prevent slack of the wires 30. This allows sufficient prevention of slack of the wires 30 even at a high frequency.

Figure 19A:
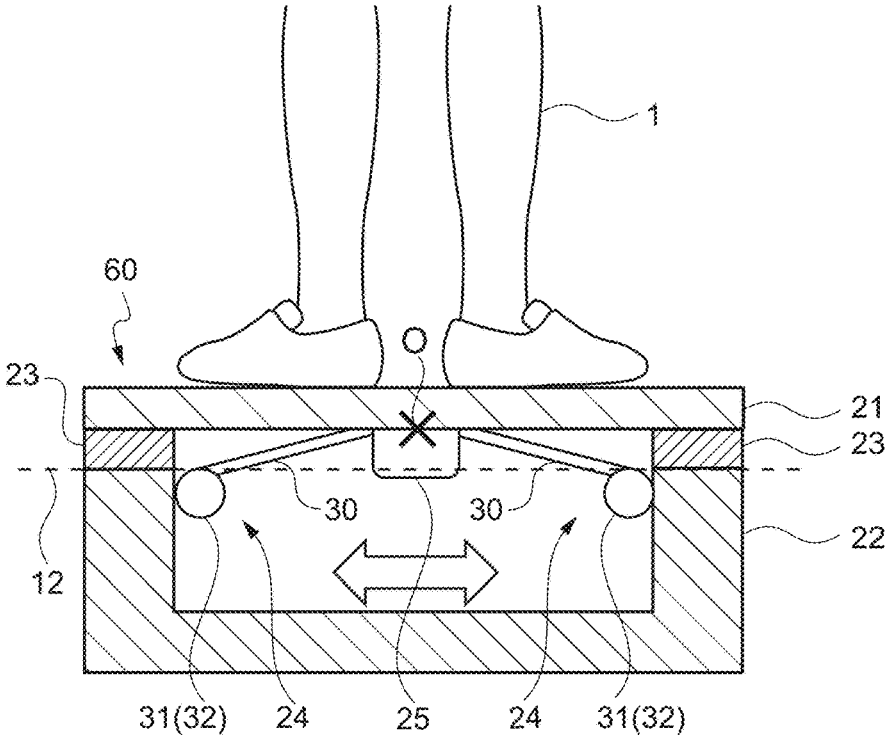
FIGS. 19A and 19B A schematic diagram showing another operation example of the tactile presentation apparatus.
Figure 19B:
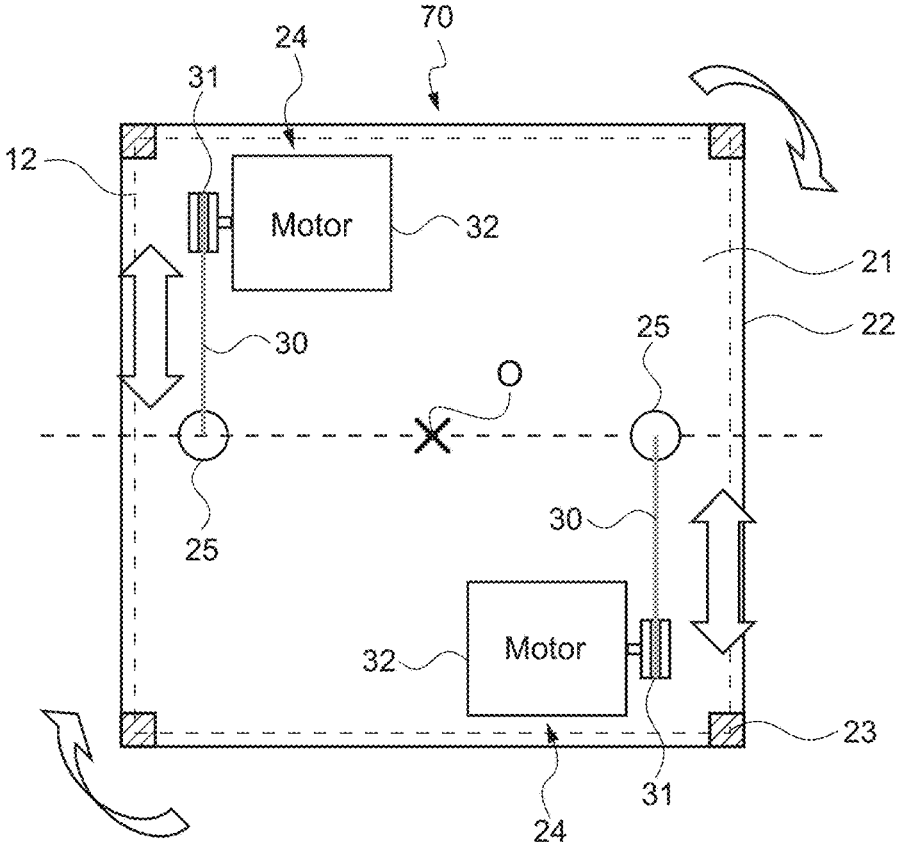

[Other Configuration Examples of Tactile Presentation Apparatus] FIGS. 19A and 19B are schematic diagrams showing another operation example of the tactile presentation apparatus. FIGS. 19A and 19B schematically show configurations of a tactile presentation apparatus 60 and a tactile presentation apparatus 70. The tactile presentation apparatus 60 and the tactile presentation apparatus 70 are different in the configuration of the drive units 24 from the tactile presentation apparatus 20 shown in FIGS. 3A and 3B.

In the tactile presentation apparatus 60 shown in FIG. 19A, a connection portion 25 is provided at a center position O of a lower surface of a top plate portion 21. Moreover, motors 32 that are the drive units 24 are arranged respectively at positions that are opposite to each other across the connection portion 25. The respective motors 32 are provided with the reels 31. The respective reels 31 are connected to the connection portion 25 provided at the middle of the top plate portion 21 via wires 30. It should be noted that the illustrations of the main bodies of the motors 32 are omitted from FIG. 19A.

In this manner, in the tactile presentation apparatus 60, the drive units 24 are arranged to pull the center position O of the top plate portion 21 in directions opposite to each other. It should be noted that the position of the connection portion does not need to be the center position O.

For example, when the left motor 32 in the figure pulls the top plate portion 21, each damper 23 is deformed to deviate leftward. As a result, the top plate portion 21 slides leftward as a whole. Moreover, when the torque of the left motor 32 decreases, the top plate portion 21 is pushed back due to the restoring forces of the dampers 23 and returns to the original position. On the contrary, the top plate portion 21 slides rightward when the right motor 32 in the figure pulls the top plate portion 21, and the top plate portion 21 returns to the original position when the torque of the right motor 32 decreases.

In this manner, in the tactile presentation apparatus 60, the drive units 24 (motors 32) pull the top plate portion 21 so that the top plate portion 21 slides along the reference surface 12.

In the example shown in FIG. 19A, for example, two motors 32 provided in opposite to each other alternately pull the top plate portion 21. As a result, the top plate portion 21 can be vibrated to slide leftward and rightward. Alternately pulling the center portion of the top plate portion 21 in this manner can present a horizontal displacement sensation.

It should be noted that an operation of displacing the top plate portion 21 in one direction by one degree may be performed. In this case, a sudden horizontal displacement or the like can be expressed.

Moreover, the direction of pulling the top plate portion 21 is not limited, and for example, the drive units 24 to pull the top plate portion 21 in front and rear directions (direction orthogonal to the sheet of FIG. 19A) may be provided. Moreover, the four drive units 24 may be provided so as to pull the top plate portion 21 in both left and right directions and the front and rear directions. This enables the top plate portion 21 to slide in an arbitrary direction along the reference surface 12.

Sliding the top plate portion 21 in this manner can give the user 1 an illusion such as a sensation of unbalancing when a train starts to move, for example.

In the tactile presentation apparatus 70 shown in FIG. 19B, the connection portions 25 are respectively provided at the positions opposite to each other across the center position O of the lower surface of the top plate portion 21. Moreover, the drive units 24 (motors 32) that pull the connection portions 25 in a direction crossing a direction connecting the center position O and the connection portions 25 are respectively arranged at the respective connection portions 25. These drive units 24 pull the respective connection portions 25 in directions opposite to each other. In FIG. 19B, the motor 32 that pulls the left connection portion 25 forward (upward in the figure) and the motor 32 that pulls the right connection portion rearward (downward in the figure) are respectively provided.

In this manner, in the tactile presentation apparatus 70, the drive units 24 are arranged so as to pull the points opposite to each other across the center position O of the top plate portion 21 in directions opposite to each other.

For example, when each motor 32 pulls the top plate portion 21, each damper 23 is deformed to twist. As a result, the top plate portion 21 rotates using a normal vector of the top plate portion 21 (reference surface 12) at the center position O as a center. Moreover, when the respective motors 32 decrease in torque, the top plate portion 21 is pushed back due to the restoring forces of the dampers 23 and returns to the original position.

In this manner, in the tactile presentation apparatus 70, the drive units 24 (motors 32) pull the top plate portion 21 so that the top plate portion 21 rotates using the axis orthogonal to the reference surface 12 (normal vector at the center position O) as a center.

In the example shown in FIG. 19B, the two motors 32 are provided so as to rotate the top plate portion 21 in a clockwise direction from the initial position. Additionally, for example, a rear motor 32 that pulls the left connection portion and a front motor 32 that pulls the right connection portion may be provided. This enables the top plate portion 21 to rotate in the clockwise direction from the initial position.

In addition, the positions and number of the connection portions 25, the direction of pulling the top plate portion 21, and the like are not limited. The top plate portion 21 is set as appropriate to be rotatable using the axis orthogonal to the reference surface 12 as a center.

In a case of controlling the operation of the tactile presentation apparatus 70, for example, the signal control unit 41 reads information specifying the rotation position of the top plate portion 21 as the force sense control file. The information specifying the rotation position specifies the direction of rotation and the rotation amount, for example. This may be information specifying a vibration involving a rotation, for example.

The signal control unit 41 selects a motor 32 (drive unit 24) that has to be rotated on the basis of the information specifying the rotation position, and generates a control signal related to the motor 32. This enables the necessary motor 32 to rotate and the top plate portion 21 to appropriately rotate.

Hereinabove, in the tactile presentation apparatuses 20, 60, and 70 according to the present embodiments, the plurality of drive units 24 (motors 32) is connected to the top plate portion 21 supported by the dampers 23. These drive units 24 move the top plate portion 21 so as to keep the dampers 23 elastically deformed. This enables the top plate portion 21 to move due to forces for the dampers 23 to restore. Thus, a compact device for presenting a wide variety of tactile senses can be realized.

Figure 20:
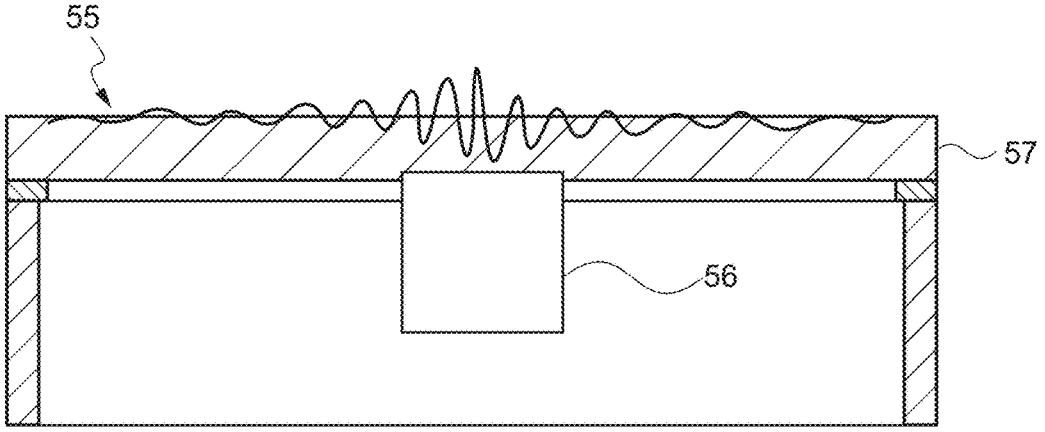
FIG. 20 A schematic diagram showing a configuration example of a vibration apparatus shown as a comparative example.

FIG. 20 is a schematic diagram showing a configuration example of the vibration apparatus shown as a comparative example. In a vibration apparatus 55 shown in FIG. 20, a vibration actuator 56 such as a voice coil motor (VCM) is directly connected to a stage 57. Vibration of the vibration actuator 56 can vibrate the stage 57. On the other hand, for example, it is difficult for the vibration actuator 56 using the VCM or the like to keep the stage 57 sunk, for example. It makes a tactile sense that the vibration apparatus 55 can express merely a vibration expression.

In the present embodiment, the drive units 24 that move the top plate portion 21 can keep the position and attitude of the top plate portion 21 changed, i.e., the dampers 23 elastically deformed. This allows expression of a state in which the top plate portion 21 is tilted or the like besides the vibration expression of the top plate portion 21. Accordingly, various tactile senses can be presented to the user 1 standing on the top plate portion 21. As a result, an acceleration sensation and a vibration as if the user is on a vehicle can be simultaneously expressed, and high entertainment properties can be provided.

Moreover, the motor 32 used as the drive unit 24 of the present embodiment often has a smaller element size as compared to the vibration actuator such as the VCM. Moreover, the arrangement of the motors 32 can be freely set in this configuration to pull the top plate portion 21 through the wires 30. It can sufficiently downsize the apparatus.

Other Embodiments

The present technology is not limited to the above-mentioned embodiments, and various other embodiments can be made.

Figure 21:
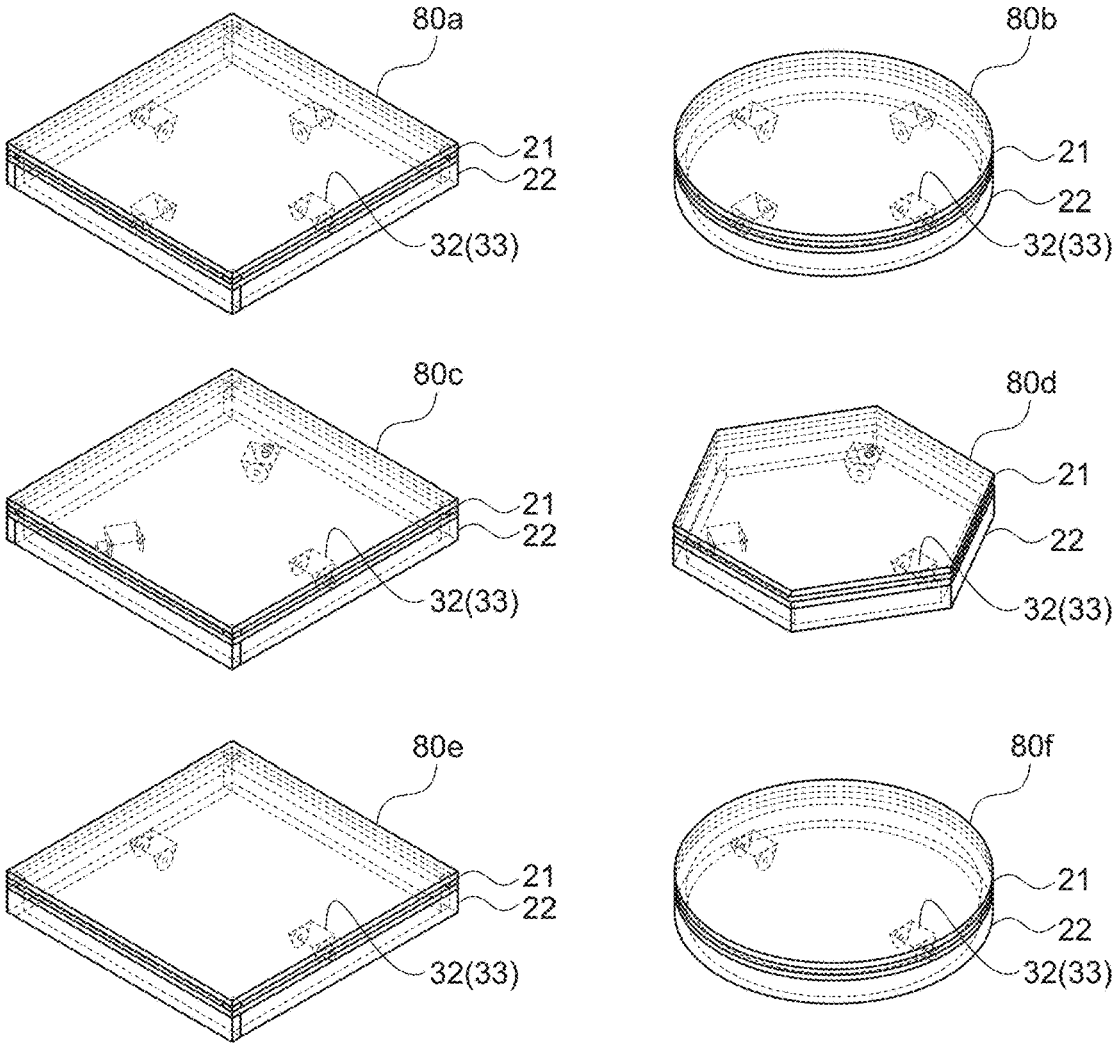
FIG. 21 A schematic diagram showing a configuration example of a tactile presentation apparatus according to another embodiment.

FIG. 21 is a schematic diagram showing a configuration example of a tactile presentation apparatus according to another embodiment.

FIG. 21 shows a perspective view showing schematic shapes of tactile presentation apparatuses 80*a* to 80*f*. In the tactile presentation apparatuses 80*a* to 80*f*, the shape of the top plate portion 21 and the number and arrangement of the drive units 24 (motors 32) are different from each other.

It is assumed that in each of the tactile presentation apparatuses 80*a* to 80*f*, the width of the top plate portion 21 is about 1000 mm and the motor 32 to be used has a size of approximately ϕ70 mm×100 mm. The size of each unit is not limited thereto as a matter of course.

It should be noted that FIG. 21 shows the arrangement positions of the motors 32 as positions of the fixtures 33 to fix the motors 32.

The tactile presentation apparatus 80*a* has a configuration similar to the tactile presentation apparatus 20 described above with reference to FIGS. 3A and 3B. Specifically, the tactile presentation apparatus 80*a* includes a top plate portion 21 and a base portion 22 each having a square plane shape and the four motors 32 arranged in a cross-form to face each other at center portions of four sides of the base portion 22.

The tactile presentation apparatus 80*b* includes a top plate portion 21 and a base portion 22 each having a circular plane shape and four motors 32 arranged in a cross-form inside the base portion 22.

Using the four motors 32 as in the tactile presentation apparatuses 80*a* and 80*b* can easily control the vibration and tilt of the top plate portion 21.

The tactile presentation apparatus 80*c* includes a top plate portion 21 and a base portion 22 each having a square plane shape and three motors 32 arranged inside the base portion 22. The three motors 32 are respectively positioned at three vertices of an equilateral triangle.

The tactile presentation apparatus 80*d* includes a top plate portion 21 and a base portion 22 each having an equilateral hexagon plane shape and three motors 32 arranged in an equilateral triangle shape to face each other at vertex positions of the base portion 22.

The configuration using the three motors 32 as in the tactile presentation apparatuses 80*c* and 80*d* is a minimized configuration capable of tilting the top plate portion 21 in an arbitrary direction.

The tactile presentation apparatus 80*e* includes a top plate portion 21 and a base portion 22 each having a square plane shape and two motors 32 arranged corresponding to center portions of two sides of the base portion 22, which are opposite to each other.

The tactile presentation apparatus 80*f* includes a top plate portion 21 and a base portion 22 each having a circular plane shape and two motors 32 arranged in opposite to each other across the center of the base portion 22.

Using the two motors 32 as in the tactile presentation apparatuses 80*e* and 80*f* can uniformly generate a vibration in the left and right directions or a vibration in the front and rear directions, for example.

In addition, the number and the position of the drive units 24 (connection portions 25) are not limited to the direction of pulling the top plate portion 21. For example, at least two of a mechanism (see FIGS. 3A, 3B, 4A, and 4B, etc.) of vibrating the top plate portion 21 in the vertical direction (Z-direction), a mechanism (see FIG. 19A) of sliding the top plate portion 21 in the horizontal direction (XY-direction), and a mechanism (see FIG. 19B) of rotating the top plate portion 21 using the vertical direction as the axis can be combined and used.

Moreover, the mechanism of sliding the top plate portion 21 in the horizontal direction enables an X-vibration or Y-vibration (e.g., front and rear vibration or left and right vibration) in the horizontal direction. Moreover, the mechanism of vibrating the top plate portion 21 in the vertical direction (Z-direction) enables roll vibration so that the top plate portion 21 alternately shakes in the front and rear or the left and right directions.

Differently controlling the motors 32 of each mechanism in this manner can achieve a wide variety of tactile expressions.

Moreover, the present technology is not limited to the case of using the plurality of drive units 24, and for example, a single drive unit 24 may constitute the tactile presentation apparatus.

For example, only one drive unit 24 (motor 32) that pulls the top plate portion 21 in the vertical direction may be provided. This allows presentation of a tactile sense with an up and down vibration.

Alternatively, for example, a configuration in which a motor 32 is vertically arranged at the middle of the base portion 22 and the reel 31 winds a wire 30 extending from an end of the top plate portion 21 may be made. In this case, one motor 32 can rotate the top plate portion 21.

Moreover, the present technology is not limited to the configuration using the wires 30, and for example, the top plate portion 21 may be directly rotated by directly connecting the motors 32 to the top plate portion 21.

Figure 22:
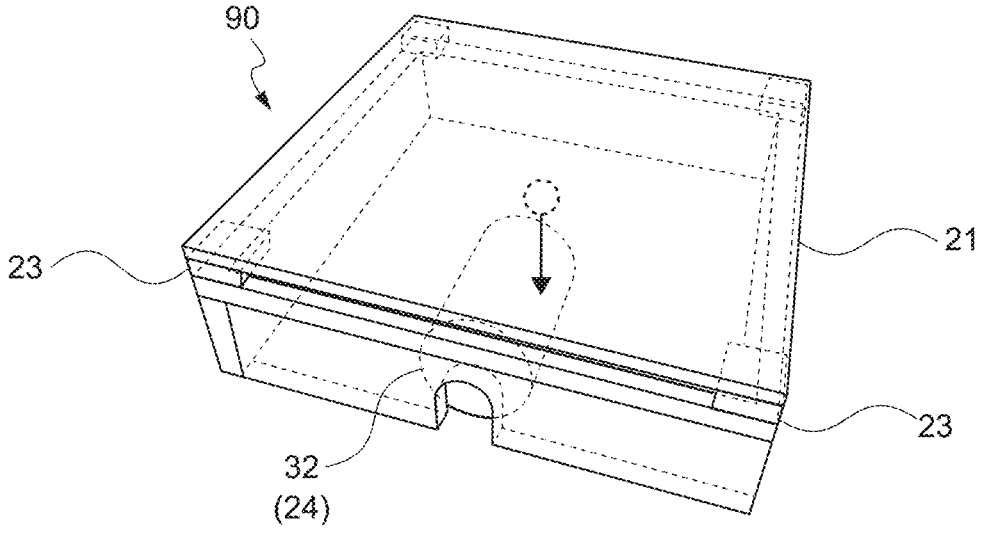
FIG. 22 A schematic diagram showing other configuration examples of the tactile presentation apparatus.

FIG. 22 is a schematic diagram showing other configuration examples of the tactile presentation apparatus.

In the above description, the tactile presentation apparatus configured as the stage on which the user 1 stands has been mainly described. The present technology is not limited thereto, and for example, the tactile presentation apparatus may be configured with a size that the user 1 can hold in hand.

FIG. 22 schematically shows a compact tactile presentation apparatus 90 on which a single motor 32 is mounted. The tactile presentation apparatus 90 includes a square top plate portion 21, dampers 23 that support four vertices of the top plate portion 21, and motors 32 that pull the middle of the top plate portion 21. It should be noted that the illustrations of the reel 31 and the wires 30 are omitted from FIG. 22. For example, vibrating the rotation of the motors 32 can vibrate the top plate portion 21. Such a tactile presentation apparatus 90 can replace a conventional compact vibrator (e.g., VCM) by configuring it to have a size that the user 1 can hold in hand, for example.

In the above description, the reels for winding the wires are directly fixed to the rotational shafts of the motors. For example, a configuration in which the reels and the motors are connected via a gear mechanism or the like may be employed. This allows a reduction of loads applied to the motors. Thus, the apparatus can be downsized.

Moreover, a guide member such as a pulley for changing the direction of the wire may be provided between the connection portion and the reel. This enables the arrangement of the motors to be designed freely.

The configuration to pull the wire may be a power source other than the motor. For example, the wire may be pulled using a linear actuator or the like. The wire may be replaced as the member that pulls the top plate portion by a rod or the like connected to the top plate portion via a free joint or the like.

Hereinabove, the case where the computer (tactile controller) of the tactile presentation apparatus on which the user gets executes the tactile control method according to the present technology is described. However, another computer capable of communicating with the tactile controller via a network or the like may execute the tactile control method and the program according to the present technology.

For example, processing in which a system controller or another computer in a network generates control signals may be executed.

That is, the tactile control method and the program according to the present technology can be executed not only in a computer system configured by a single computer but also in a computer system in which a plurality of computer cooperates. It should be noted that In the present disclosure, the system means a set of a plurality of components (apparatuses, modules (components), and the like) and it does not matter whether or not all components is in the same casing. Therefore, a plurality of apparatuses housed in separate casings and connected via a network and a single apparatus in which a plurality of modules is housed in a single casing are both systems.

The execution of the tactile control method and the program according to the present technology by the computer system includes, for example, both a case where the processing of acquiring the specifying information and the processing of controlling the drive unit are executed by a single computer and a case where the respective processes are executed by different computers. Moreover, execution of the respective processes by a predetermined computer includes causing another computer to execute some or all of the processes to acquire the results.

That is, the tactile control method and the program according to the present technology can also be applied to a cloud computing configuration in which a single function is shared and processed cooperatively by a plurality of apparatuses via a network.

At least two features of the features according to the present technology as described above may be combined. That is, the various features described in the respective embodiments may be arbitrarily combined across the respective embodiments. Moreover, the above-mentioned various effects are merely exemplary and not limitative, and other effects may be provided.

In the present disclosure, it is assumed that "the same", "equal", "orthogonal", and the like are concepts including "substantially the same", "substantially equal", "substantially orthogonal", and the like. For example, states included in a predetermined range (e.g., ±10% range) using "completely the same", "completely equal", "completely orthogonal", and the like as bases are also included.

It should be noted that the present technology can also take the following configurations.

(1) A tactile presentation apparatus, including:
  a movable member;
  an elastic portion for supporting the movable member; and
  at least one drive unit that is connected to the movable member, moves the movable member so as to elastically deform the elastic portion, and is capable of keeping the elastic portion elastically deformed.

(2) The tactile presentation apparatus according to (1), in which
  the movable member is a stage on which a user is able to get.

(3) The tactile presentation apparatus according to (1) or (2), further including
  a tactile control unit that acquires specifying information regarding a vibration or attitude of the movable member and controls the at least one drive unit on the basis of the specifying information.

(4) The tactile presentation apparatus according to (3), in which
  the movable member includes at least one connection portion to which the at least one drive unit is connected, and
  the at least one drive unit moves the movable member by pulling the connection portion to the at least one drive unit is connected.

(5) The tactile presentation apparatus according to (4), in which the movable member is a plate-like member arranged along a reference surface, and the drive unit pulls the movable member in a direction crossing the reference surface.

(6) The tactile presentation apparatus according to (5), in which the drive unit pulls the movable member in a direction orthogonal to the reference surface.

(7) The tactile presentation apparatus according to (5), in which the drive unit pulls the movable member so that the movable member slides along the reference surface.

(8) The tactile presentation apparatus according to (5), in which the drive unit pulls the movable member so that the movable member rotates using an axis orthogonal to the reference surface as a center.

(9) The tactile presentation apparatus according to any one of (4) to (8), in which the specifying information includes information specifying a vibration pattern of the movable member, and the tactile control unit selects a drive unit of the at least one drive unit, which corresponds to the vibration pattern, and fluctuates an amount of pulling by which the selected drive unit pulls the movable member in accordance with the vibration pattern.

(10) The tactile presentation apparatus according to any one of (4) to (9), in which the specifying information includes information specifying a tilted attitude of the movable member, and the tactile control unit selects a drive unit from the at least one drive unit, which corresponds to the tilted attitude, and keeps an amount of pulling by which the selected drive unit pulls the movable member at a value according to the tilted attitude.

(11) The tactile presentation apparatus according to any one of (3) to (10), in which the drive unit includes a wire connected to the movable member, a reel for winding the wire, and a motor for rotating the reel, and the tactile control unit generates a control signal to control rotation of the motor on the basis of the specifying information.

(12) The tactile presentation apparatus according to (11), in which the reel is configured so that an amount of winding the wire decreases as a rotation amount of the motor increases.

(13) The tactile presentation apparatus according to (11) or (12), in which the control signal is a signal specifying a voltage to drive the motor or a rotation amount of the motor.

(14) The tactile presentation apparatus according to any one of (11) to (13), further including a load sensor that detects load information representing a load applied to the motor, in which the tactile control unit corrects the control signal on the basis of the load information.

(15) The tactile presentation apparatus according to (14), in which the load sensor includes at least one of a current sensor that detects a current flowing through the motor, a pressure sensor that detects a pressure with respect to the movable member, and an attitude sensor that detects an attitude of the movable member.

(16) The tactile presentation apparatus according to any one of (11) to (15), in which the at least one drive unit includes a plurality of drive units, and the tactile control unit corrects the control signal on the basis of the load information so that a load on the motor that each of the plurality of drive units has is equal.

(17) The tactile presentation apparatus according to any one of (11) to (16), in which the tactile control unit estimates a load applied to the movable member on the basis of the load information and corrects the control signal so that a force by which the motor pulls the movable member increases as the load increases.

(18) The tactile presentation apparatus according to any one of (11) to (17), in which the movable member is a stage on which a user is able to get, and the tactile control unit estimates a position of user on the movable member on the basis of the load information and corrects the control signal to an amount of pulling by which the motor pulls the movable member decreases when the position of the user is an end of the movable member.

(19) The tactile presentation apparatus according to any one of (11) to (18), in which the tactile control unit rotates the motor so as to eliminate slack of the wire.

(20) A tactile control apparatus, including:

an acquisition unit that acquires specifying information regarding a vibration or attitude of a movable member supported by an elastic portion; and a control unit that controls at least one drive unit on the basis of the specifying information, the at least one drive unit being connected to the movable member, moving the movable member so as to elastically deform the elastic portion, and being capable of keeping the elastic portion elastically deformed.

REFERENCE SIGNS LIST

1 user
12 reference surface
20, 60, 70, 80*a* to 80*f*, 90 tactile presentation apparatus
21 top plate portion
22 base portion
23 damper
24, 24*a* to 24*d* drive unit
25 connection portion
30 wire
31, 31*a*, 31*b* reel
32, 32*a* to 32*d* motor
33 fixture
36 current sensor
37 storage unit
40 tactile controller
41 signal control unit
42 calibration processing unit
100 tactile presentation system

The invention claimed is:

1. A tactile presentation apparatus, comprising:

a movable member;

a plurality of elastic members for supporting an entirety of the movable member; and at least one drive unit that is connected to the movable member, wherein the movable member includes at least one connection portion to which the at least one drive unit is connected, and the at least one drive unit moves the movable member by pulling the at least one connection portion towards the at least one drive unit so as to elastically deform the plurality of elastic members and is capable of keeping the plurality of elastic members elastically deformed.

2. The tactile presentation apparatus according to claim 1, wherein the movable member is a stage on which a user is able to get.

3. The tactile presentation apparatus according to claim 1, further comprising a tactile control unit that acquires specifying information regarding a vibration or attitude of the movable member and controls the at least one drive unit on a basis of the specifying information.

4. The tactile presentation apparatus according to claim 3, wherein the movable member is a plate-like member arranged along a reference surface, and the at least one drive unit pulls the movable member in a direction crossing the reference surface.

5. The tactile presentation apparatus according to claim 4, wherein the at least one drive unit pulls the movable member in a direction orthogonal to the reference surface.

6. The tactile presentation apparatus according to claim 4, wherein the at least one drive unit pulls the movable member so that the movable member slides along the reference surface.

7. The tactile presentation apparatus according to claim 4, wherein the at least one drive unit pulls the movable member so that the movable member rotates using an axis orthogonal to the reference surface as a center.

8. The tactile presentation apparatus according to claim 3, wherein the specifying information includes information specifying a vibration pattern of the movable member, and the tactile control unit selects a drive unit of the at least one drive unit, which corresponds to the vibration pattern, and fluctuates an amount of pulling by which the selected drive unit pulls the movable member in accordance with the vibration pattern.

9. The tactile presentation apparatus according to claim 3, wherein the specifying information includes information specifying a tilted attitude of the movable member, and the tactile control unit selects a drive unit from the at least one drive unit, which corresponds to the tilted attitude, and keeps an amount of pulling by which the selected drive unit pulls the movable member at a value according to the tilted attitude.

10. The tactile presentation apparatus according to claim 3, wherein the at least one drive unit includes a wire connected to the movable member, a reel for winding the wire, and a motor for rotating the reel, and the tactile control unit generates a control signal to control rotation of the motor on a basis of the specifying information.

11. The tactile presentation apparatus according to claim 10, wherein the reel is configured so that an amount of winding the wire decreases as a rotation amount of the motor increases.

12. The tactile presentation apparatus according to claim 10, wherein the control signal is a signal specifying a voltage to drive the motor or a rotation amount of the motor.

13. The tactile presentation apparatus according to claim 10, further comprising a load sensor that detects load information representing a load applied to the motor, wherein the tactile control unit corrects the control signal on a basis of the load information.

14. The tactile presentation apparatus according to claim 13, wherein the load sensor includes at least one of a current sensor that detects a current flowing through the motor, a pressure sensor that detects a pressure with respect to the movable member, and an attitude sensor that detects an attitude of the movable member.

15. The tactile presentation apparatus according to claim 10, wherein the at least one drive unit includes a plurality of drive units, and the tactile control unit corrects the control signal on a basis of load information so that a load on the motor that each of the plurality of drive units has is equal.

16. The tactile presentation apparatus according to claim 10, wherein the tactile control unit estimates a load applied to the movable member on a basis of load information and corrects the control signal so that a force by which the motor pulls the movable member increases as the load increases.

17. The tactile presentation apparatus according to claim 10, wherein the movable member is a stage on which a user is able to get, and the tactile control unit estimates a position of the user on the movable member on a basis of load information and corrects the control signal to an amount of pulling by which the motor pulls the movable member decreases when the position of the user is an end of the movable member.

18. The tactile presentation apparatus according to claim 10, wherein the tactile control unit rotates the motor so as to eliminate slack of the wire.

* * * * *